US009328511B2

(12) United States Patent
Kang et al.

(10) Patent No.: US 9,328,511 B2
(45) Date of Patent: May 3, 2016

(54) METHOD FOR MANUFACTURING SANDWICH PANEL HAVING CORE OF TRUSS STRUCTURE

(75) Inventors: Ki Ju Kang, Jeollanam-do (KR); Ki Won Lee, Naju-si (KR); Hun Ho Kwak, Gwangju (KR); Hyun Hee Lee, Naju-si (KR); A Reum Kim, Gwangju (KR)

(73) Assignee: INDUSTRY FOUNDATION OF CHONNAM NATIONAL UNIVERSITY, Gwangju (KR)

( * ) Notice: Subject to any disclaimer, the term of this patent is extended or adjusted under 35 U.S.C. 154(b) by 327 days.

(21) Appl. No.: 13/977,421

(22) PCT Filed: Feb. 14, 2011

(86) PCT No.: PCT/KR2011/000979

§ 371 (c)(1),
(2), (4) Date: Jun. 28, 2013

(87) PCT Pub. No.: WO2012/091213

PCT Pub. Date: Jul. 5, 2012

(65) Prior Publication Data

US 2013/0276308 A1 Oct. 24, 2013

(30) Foreign Application Priority Data

Dec. 29, 2010 (KR) ..... 10-2010-0137476

(51) Int. Cl.
*E04C 2/36* (2006.01)
*B21F 27/12* (2006.01)
(Continued)

(52) U.S. Cl.
CPC . *E04C 2/36* (2013.01); *B21F 27/12* (2013.01); *B21F 27/20* (2013.01); *E04C 2/3405* (2013.01); *E04C 2002/3488* (2013.01); *Y10T 29/49616* (2015.01)

(58) Field of Classification Search
CPC . E04C 2/36; E04C 2/3405; E04C 2002/3488; B21F 27/12; B21F 27/20; Y10T 29/49616
See application file for complete search history.

(56) References Cited

U.S. PATENT DOCUMENTS

| | | | |
|---|---|---|---|
| 2,986,241 | A | 5/1961 | Fuller |
| 2002/0170941 | A1 | 11/2002 | Wallach |
| 2010/0323181 | A1 | 12/2010 | Nutt |

FOREIGN PATENT DOCUMENTS

| | | | |
|---|---|---|---|
| KR | 10-2006-0066766 | A | 6/2006 |
| KR | 10-2006-0095968 | A | 9/2006 |

(Continued)

OTHER PUBLICATIONS

I. Verpoest et al., 2.5D- and 3D-fabrics for delamination resistant composite laminates and sandwich structures, SAMPE Journal, vol. 25, No. 3, May/Jun. 1989.

(Continued)

*Primary Examiner* — Moshe Wilensky
(74) *Attorney, Agent, or Firm* — Paratus Law Group, PLLC

(57) ABSTRACT

Provided is a method for manufacturing a panel including a core having a truss structure between upper and lower face sheets. The manufacturing method includes disposing the upper and lower face sheets in parallel to each other at a predetermined distance, repeatedly performing, several times, a process in which a plurality of flexible wires vertically pass through the upper and lower face sheets to reciprocation-connect the upper and lower face sheets to each other, thereby sewing the upper and lower face sheets after the upper and lower face sheets horizontally move in parallel to each other, and maximally spacing both face sheets in a vertical direction while being maintained in a parallel to each other after a relative displacement of the upper and lower face sheets is solved, and fixing the face sheets and the wires to each other.

13 Claims, 50 Drawing Sheets

(51) Int. Cl.
*B21F 27/20* (2006.01)
*E04C 2/34* (2006.01)

(56) References Cited

FOREIGN PATENT DOCUMENTS

| | | | |
|---|---|---|---|
| KR | 10-2006-0130539 | A | 12/2006 |
| KR | 10-2010-0096382 | A | 9/2010 |
| KR | 10-2011-0022468 | A | 3/2011 |
| KR | 10-2011-0139543 | A | 12/2011 |
| WO | WO 2008066225 | A1 * | 6/2008 |

OTHER PUBLICATIONS

David J. Sypeck et al., Cellular metal truss core sandwich structures, Advanced Engineering Materials, 2002, No. 10, Wiley-VCH Verlag GmbH & Co. KGaA, Weinheim.

S. Hyun et al., Simulated properties of Kagome and tetragonal truss core panels, International Journal of Solids and Structures 40 (2003), Elsevier Ltd.

K Drechsler et al., Integrally Woven Sandwich-Structures, Proc ECCM-3, Bordeaux 1989, pp. 365-371.

S. Chiras et al., The structural performance of near-optimized truss core panels, International Journal of Solids and Structures 29 (2002), Elsevier Ltd.

D.J. Sypeck et al., Multifuctional microtruss laminates: Textile synthesis and properties, J. Mater. Res., vol. 16, No. 3, Mar. 2001, Materials Research Society.

Yong-Hyun Lee et al., A wire-woven cellular metal: Part-II. Evaluation by experiments and numerical simulations, Materials and Design 30 (2009) Elsevier Ltd.

A.W. Van Vuure et al., Mechanical properties of composite panels based on woven sandwich-fabric preforms, Composites: Part A 31 (2000) Elsevier Science Ltd.

A.G. Evans et al., The topological design of multifunctional celluar metals, Progress in Materials Science 46 (2001), Elsevier Science Ltd.

* cited by examiner

PYRAMID TRUSS

OCTET TRUSS

KAGOME TRUSS (a)

(b)

(a)

(b)

(a)

(b)

(a)

(b)

(a)

(b)

METHOD FOR MANUFACTURING SANDWICH PANEL HAVING CORE OF TRUSS STRUCTURE

CROSS REFERENCE TO PRIOR APPLICATION

This application is a National Stage Patent Application of PCT International Patent Application No. PCT/KR2011/000979 (filed on Feb. 14, 2011) under 35 U.S.C. §371, which claims priority to Korean Patent Application No. 10-2010-0137476 (filed on Dec. 29, 2010), which are all hereby incorporated by reference in their entirety.

TECHNICAL FIELD

The present invention relates to a manufacturing method of a sandwich panel with a truss type core between upper/lower face sheets.

BACKGROUND ART

In general, sandwich panels are constituted by high-density high-strength upper/lower face sheets and low-density low-strength cores. When compared to general panels formed of a uniform one material, sandwich panels have been widely used in structures of which lightweight and high strength and stiffness are required because of high strength and stiffness to weight ratio. Thus, sandwich panels are being widely used in furniture, civil engineering, and constructive materials as well as high-priced advanced structures such as wings for airplane and the bottom of passenger room. A fiber reinforced plastic (FRP) face sheet and a honeycomb core may be considered as the most ideal combination in sandwich panels. However, since the honeycomb core has a closed inner space, the inner space of the honeycomb is not used. Also, since the core and the face sheet are connected to each other by using an adhesive having low adhesion strength, the sandwich panels may be vulnerable to, particularly, a fatigue load.

In recent, a lightweight structure having a periodical truss structure has been developed as a material for cores. Since the lightweight structure has a truss structure designed to provide optimum strength and stiffness through accurate mathematical/mechanical calculation, the lightweight structure may have superior mechanical properties. Here, the most general truss in structural shape may be a pyramid truss and an octet truss (see R. Buckminster Fuller, 1961, U.S. Pat. No. 2,986,241). Recently, as a modification of the octet truss, Kagome truss has been known (see S. Hyun, A. M. Karlsson, S. Torquato, A. G. Evans, 2003. Int. J. of Solids and Structures, Vol. 40, pp. 6989-6998). In this case, if the whole members constituting the truss have the same length when thin and long members having the same section constitute the truss, each of truss elements constituting the Kagome truss may have just a length equal to half of that of each of truss elements constituting the octet truss. Thus, buckling that is a main fracture phenomenon of trusses may be more effectively restricted. Also, even though the buckling occurs, the truss may more stably collapse. For example, each of the pyramid, octet, and Kagome trusses is three-dimensionally illustrated in FIG. 1. Since a truss has an opened inner space, the truss may be used as various purposes such as a fluid storage or path and a thermal transfer medium. In addition, if the truss is used as a sandwich core, the truss may obtain strength to weight ratio that comes close to that of the sandwich panel (see A. G. Evans, J. W. Hutchinson, N. A. Fleck, M. F. Ashby, H. N. G. Wadley, 2001, Progress in Materials Science, Volume 46, Issues 3-4, pp. 309-327). For this reason, the truss is coming into the spotlight.

Methods for manufacturing a truss-type porous lightweight structure are known as follows. First, there is a method in which a truss structure is manufactured using a resin, and then a metal is molded by using the truss structure as a mold (see S. Chiras, D. R. Mumm, N. Wicks, A. G. Evans, J. W. Hutchinson, K. Dharmasena, H. N. G. Wadley, S. Fichter, 2002, International Journal of Solids and Structures, Vol. 39, pp. 4093-4115) (hereinafter, referred to as "Prior art 1"). Second, there is a method in which a thin metal plate is punched at a predetermined interval to manufacture a mesh-shaped plate, the mesh-shaped plate is bent to form a truss intermediate layer, a face plate is attached on each of upper and lower portions of the truss intermediate layer (see D. J. Sypeck and H. N. G. Wadley, 2002, Advanced Engineering Materials, Vol. 4, pp. 759-764) (hereinafter, referred to as "Prior art 2"). In this case, when it is intended to manufacture a multilayered structure including at least two layers, the truss intermediate layer that is bent as described above is attached on an upper face plate, and then a face plate is attached again on the truss intermediate layer. Third, there is a method in which wires disposed in two directions perpendicular to each other are woven in a mesh shape to form iron meshes, and then the iron meshes are stacked on each other (see D. J. Sypeck and H. G. N. Wadley, 2001, J. Mater. Res., Vol. 16, pp. 890-897) (hereinafter, referred to as "Prior art 3").

However, Prior art 1 may have a complicated manufacturing process and an expensive manufacturing cost. Also, since Prior art 1 is applied to only a metal having superior moldability, an application scope may be narrow. In addition, the resultant product may have many defects on the cast structure and low strength. According to Prior art 2, a large amount of materials is lost when the thin metal plate is punched. Even though there is no special problem when the truss intermediate layer is manufactured as one body, if a plurality of truss intermediate layers are stacked, the number of bonded portions may increase, and thus there are disadvantageous in aspects of bonding costs and structural strength. Also, in the case of Prior art 3, since the truss does not have an ideal structure such as the tetrahedron or pyramid structure, the truss may have inferior mechanical strength. In addition, since the iron meshes should be stacked and bonded in the same method as that of Prior art 2, the number of bonded portions may increase, and thus there are disadvantageous in aspects of bonding costs and structural strength.

FIG. 2 is a view of a structure manufactured using Prior art 3. More particularly, even though it is known that manufacturing costs can be reduced in Prior art 3, as shown in FIG. 3, since wires disposed in the two directions perpendicular to each other are combined with each other as if fibers are woven, the truss may not have the optimally ideal structure in mechanical or electrical properties, such as the three-dimensional (3D) octet truss and the 3D Kagome truss. Also, since the number of bonded portions increases, there are disadvantageous in aspects of bonding costs and structural strength.

Thus, to solve the above-described problems of Prior arts 1, 2, and 3, a 3D porous lightweight structure in which a manufacturing method in which a wire group in which six-directional continuous wires having an azimuth of about 60 degrees to about 120 degrees are crossed with each other in a space to form a truss having a shape similar to that of the ideal Kagome or octet truss, and a manufacturing method thereof are developed by the present inventors, i.e., Kang Ki-ju et al. The structure and manufacturing method are concretely disclosed in KR Patent Registration No. 0708483. Also, a 3D porous lightweight structure woven using a spiral wire, in which a continuous wire is formed in a spiral shape, and then, the spiral-shaped wire is rotated and inserted to manufacture the 3D porous lightweight structure, and a manufacturing method thereof are proposed as a method for more effectively manufacturing the 3D porous lightweight structure by the same inventors. The structure and manufacturing method are concretely disclosed in KR Patent Publication No. 2006-0130539.

FIG. 3 is a view of a structure having a shape similar to that of the 3D Kagome truss of FIG. 1 and assembled using a spiral wire. The 3D multilayered truss structure of FIG. 3 having the shape similar to that of the Kagome truss and manufactured by using the spiral wire may have several advantages such as superior mechanical properties and mass productivity due to the successive process when compared to the conventional truss structure.

A method for manufacturing a new 3D porous lightweight structure which may be manufactured using a spiral wire and have a shape different from that of the Kagome truss is proposed in KR Patent Application No. 10-2009-0080085 by the same inventors. FIG. 4 is a view illustrating an example of the truss structure assembled using the spiral wire, which is disclosed in KR Patent Application No. 10-2009-0080085.

Also, a new 3D lattice truss structure which may be manufactured using the spiral wire and have a structure in which only two wires meet each other at a wire cross point to manufacture the 3D lattice truss structure by using a spiral wire having a more less spiral radius, and a manufacturing method thereof are proposed in KR Patent Application No. 10-2010-00 59690 by the same inventors. FIG. 5 is a view illustrating an example of the truss structure assembled using the spiral wire, which is disclosed in KR Patent Application No. 10-2010-00 59690.

A similar truss structure using a continuous wire is being evaluated as a metal sandwich panel having superior mechanical performance in strength to weight ratio and high mass productivity (see Yong-Hyun Lee, Byeong-Kon Lee, Insu Jeon and Ki-Ju Kang, 2007, Acta Materialia, Vol. 55, pp. 6084-6094. Yong-Hyun Lee, Ji-Eun Choi and Ki-Ju Kang, 2009, Materials and Design, Vol. 30, Issue 10, pp. 4459-4468). Since wire crossing portions and portions contacting face sheets of the similar truss structure formed of the metal are bonded using brazing or welding, the truss structure may have bonding strength as superior as that of a mother material of the wire or face sheet. However, in a case where a similar truss structure using a wire such as FRP or tungsten in which the performing of the welding or brazing is difficult is manufactured, only a method using a synthetic resin adhesive may be utilized to bond wire crossing portions and portions contacting face sheets to each other. In this case, bonding strength may be significantly inferior to that of the welded or brazed metal. Particularly, the portions bonded to the face sheets may be vulnerable to separate cores from the face sheets.

A process for manufacturing a sandwich panel from an intermediate product of an existing velvet weaving process has been developed by Belgium's and Germany's research teams (see Drechsler K, Brandt J, Arendts F J. Integrally woven sandwich structures. Proc ECCM-3, Bordeaux 1989. p. 365-371. Verpoest I, Bonte Y, Wevers M, de Meester P., Declercq P. 2.5D- and 3D-fabrics for delamination resistant composite structures. Proc European SAMPE, Milano, Italy 1988. p. 13-21). FIG. 6A is a schematic view of an existing velvet weaving process. A 3D fabric having a sandwich shape as shown at a middle portion of FIG. 6A is manufactured through a manner in which a weft is reciprocated between top and bottom warps as shown at a left side of FIG. 6A. Then, as shown at a right side of FIG. 6A, the weft between the top and bottom warps is bisected by using a sharp knife to manufacture a velvet cloth having soft hairs on one surface thereof. A process in which a 3D fabric that is an intermediate product is manufactured using a fiber for reinforcing a composite such as a glass fiber is manufactured, and then, a syntactic resin such as epoxy is injected into the 3D fabric to manufacture a sandwich panel has been developed by the two research teams. FIG. 6B is a photograph of the sandwich panel manufactured through the above-described method. The sandwich panel may be called a "woven sandwich-fabric panel", "integrally woven sandwich", or "woven textile sandwich". Since a core and a face sheet are bonded by using the weft woven with the warps constituting the face sheet and continuously connected to each other, but using the syntactic resin adhesive, the sandwich panel may have resistance with respect to the separation between the core and the face sheet may be significantly superior when compared to that of the existing composite/honeycomb sandwich panel. However, since the weft constituting the core is bent and does not have a truss shape, the sandwich panel may have low strength and stiffness with respect to compression and shearing. Thus, the sandwich panel is being utilized in use for which a high load is not applied, such as a use for a partition of a building or furniture (see van Vuure A W, Ivens J A, Verpoest I. Mechanical properties of composite panels based on woven sandwich-fabric preforms. Composites Part A 2000; 31: 671-680).

DISCLOSURE

Technical Problem

In order to solve the above technical problems, an embodiment of the present invention provides a method for manufacturing a new sandwich panel in low costs and large quantities, in which a core and a face sheet are coupled to each other by using a flexible continuous wire, and the core is formed in a 3D truss shape to increase separation resistance between the core and the face sheet and compression, shearing, and banding strength to weight ratio, reduce a weight thereof, and utilize an empty space therein.

Technical Solution

According to an aspect of the present invention, a method for manufacturing a panel including a core having a truss structure between upper and lower face sheets includes: disposing the upper and lower face sheets in parallel to each other at a predetermined distance; repeatedly performing, several times, a process in which a plurality of flexible wires vertically pass through the upper and lower face sheets to reciprocation-connect the upper and lower face sheets to each other, thereby sewing the upper and lower face sheets after the upper and lower face sheets horizontally move in parallel to each other; and maximally spacing both face sheets in a vertical direction while being maintained in a parallel to each other after a relative displacement of the upper and lower face sheets is solved, and fixing the face sheets and the wires to each other.

The sewing of the upper and lower face sheets may include: (a) relatively moving the upper and lower face sheets in parallel to each other so that a virtual z-directional vertical axis passing through the upper and lower face sheets is inclined on an x-z plane at a first angle in a positive direction of an x-axis and on a y-z plane at a second angle in a negative direction of a y-axis; (b) performing a first sewing process in which the upper and lower face sheets are reciprocation-sewed in a y-axis direction by using a first wire, wherein a sewing distance in the y-axis direction corresponds to a second displacement distance of the face sheets according to the second angle, continuous wire sewing rows are spaced apart from each other by a first displacement distance of the face sheets according to the first angle, and ends of the sewing rows adjacent to each other are displaced by about ½ of the second displacement distance in the y-axis direction; (c) relatively moving the upper and lower face sheets in parallel to each other so that a support shaft is inclined on the y-z plane at an angle corresponding to about two times of the second angle in the positive direction of the y-axis; (d) performing a second sewing process in which the upper and lower face sheets are reciprocation-sewed in the y-axis direction by using a second wire, wherein, since through-positions of the wires with respect to the face sheets are the same as those of the wires in the first sewing process, the second sewing process is performed through the same method as the first sewing process; (e) relatively moving the upper and lower face sheets in parallel to each other so that the support shaft is inclined on the y-z plane at the second angle in the negative direction of the y-axis, and the support shaft is inclined on the x-z plane at an angle corresponding to about two times of the first angle in a negative direction of the x-axis; and (f) reciprocation-sewing the upper and lower face sheets in an x-axis direction by using a third wire, wherein a sewing distance in the x-axis direction is double first displacement distance, continuous wire sewing rows are spaced about ½ of the second displacement distance from each other, and ends of the sewing row adjacent to each other are displaced by the first displacement distance in the x-axis direction.

The sewing distances in the x-axis direction and the y-axis direction may be four times and two times the first and second displacement distances, respectively.

The sewing of the upper and lower face sheets may include: (a) relatively moving the upper and lower face sheets in parallel to each other so that a virtual z-directional vertical axis passing through the upper and lower face sheets is inclined on an x-z plane at a first angle in a positive direction of an x-axis and on a y-z plane at a second angle in a negative direction of a y-axis; (b) performing a first sewing process in which the upper and lower face sheets are reciprocation-sewed in a y-axis direction by using a first wire, wherein a sewing distance in the y-axis direction corresponds to a second displacement distance of the face sheets according to the second angle, and continuous wire sewing rows are spaced apart from each other by a first displacement distance of the face sheets according to the first angle; (c) relatively moving the upper and lower face sheets in parallel to each other so that a support shaft is inclined on the x-z plane at an angle corresponding to about two times of the first angle in a negative direction of the x-axis; (d) performing a second sewing process in which the upper and lower face sheets are reciprocation-sewed in the x-axis direction by using a second wire, wherein through-positions of the wires with respect to the face sheets are the same as those of the wires in the first sewing process, a sewing distance in the x-axis direction corresponds to the first displacement distance of the face sheets according to the first angle, and continuous wire sewing rows are spaced apart from each other by the second displacement distance of the face sheets according to the second angle in the y-axis direction; (e) relatively moving the upper and lower face sheets in parallel to each other so that a support shaft is inclined on the y-z plane at an angle corresponding to about two times of the first angle in a positive direction of the y-axis; (f) performing a third sewing process in which the upper and lower face sheets are reciprocation-sewed in the y-axis direction by using a third wire, wherein through-positions of the wires with respect to the face sheets are the same as those of the wires in the first and second sewing processes, a sewing distance in the y-axis direction corresponds to the second displacement distance of the face sheets according to the second angle, and continuous wire sewing rows are spaced apart from each other by the first displacement distance of the face sheets according to the first angle in the x-axis direction; (g) relatively moving the upper and lower face sheets in parallel to each other so that a support shaft is inclined on the x-z plane at an angle corresponding to about two times of the first angle in a positive direction of the x-axis; and (h) performing a fourth sewing process in which the upper and lower face sheets are reciprocation-sewed in the x-axis direction by using a fourth wire, wherein through-positions of the wires with respect to the face sheets are the same as those of the wires in the first to third sewing processes, a sewing distance in the x-axis direction corresponds to the first displacement distance of the face sheets according to the first angle, and continuous wire sewing rows are spaced apart from each other by the second displacement distance of the face sheets according to the second angle in the y-axis direction.

The sewing distances in the x-axis direction and the y-axis direction may be two times the first and second displacement distances, respectively.

At least one panel may be added between the upper and lower sheets.

The wire through-positions on the upper and lower sheets may be different from each other in the sewing processes.

The method may further include coupling a reinforcing plate to at least one of the upper and lower sheets after the face sheets and the wires are fixed.

The plurality of wires may include one continuous wire.

Each of the wires may be formed of the fiber material, and face sheet contact parts, the wires, and wire crossing parts may be cured and fixed at the same time by using an adhesive.

According to another aspect of the present invention, a method for manufacturing a panel comprising a core having a truss structure between upper and lower face sheets includes: disposing the upper and lower face sheets in parallel to each other at a predetermined distance; repeatedly performing, several times, a process in which a plurality of flexible wires vertically pass through the upper and lower face sheets to reciprocation-connect the upper and lower face sheets to each other in a state where the upper and lower face sheets are fixed; and fixing the face sheets and the wires to each other.

Advantageous Effects

In the method for manufacturing the panel according to the present invention, the manufacturing process may be simplified, and the sandwich panel having the truss core may be manufactured with a low cost by using only existing developed technologies.

Also, the sandwich panel manufactured according toe the present invention may have significantly superior resistance against the core/face sheet separation when compared to that of the existing composite/honeycomb sandwich panel even though other material such as the resin or filler metal is not used for the bonding parts of the upper and lower face sheets and the wire because the wire constituting the core is connected to the face sheets without being cut off.

Also, since the sandwich panel manufactured according to the present invention has the 3D truss structure in which the core is not bent nearly, the strength to weight ratio may be relatively high, and the inner space thereof may be utilized.

Also, in the sandwich panel manufactured according to the present invention, in case where the core is formed of the flexible wire (e.g., a metal) having a predetermined stiffness in itself, satisfied compression, shearing, and bending strength to weight ratio on the basis of the stiffness of the wire in itself and mechanical structure of the truss may be achieved. If the core is formed of a wire material having an insufficient stiffness in itself such as the uni-directional yarn, the 3-D truss structure may be formed, and then, a separate resin may be sprayed to impregnate the 3-D truss structure in the resin, thereby curing the 3-D truss structure. As a result, the face sheet contact parts, the wire, and wire cross parts may be fixed at the same time to manufacture the economical and high-strength sandwich panel having the simple structure.

DESCRIPTION OF DRAWINGS

The above and other features and advantages of the present invention will become more apparent by describing in detail exemplary embodiments thereof with reference to the attached drawings in which.

BEST MODE

Figure 1:
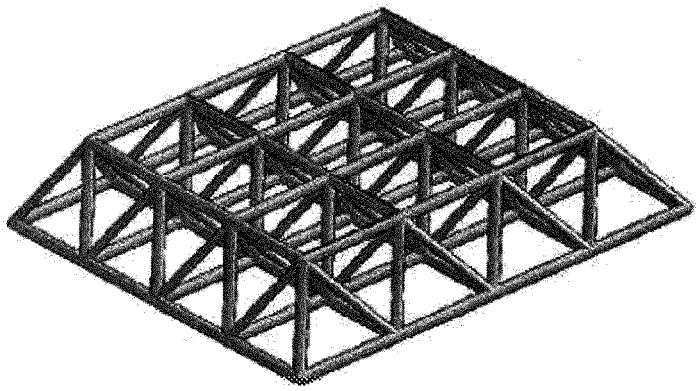
FIG. 1 is a view of three-dimensional (3D) pyramid, octet, and Kagome trusses.
Figure 1:
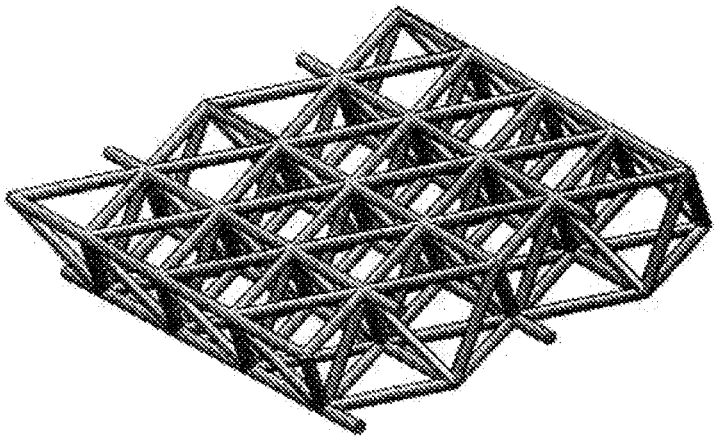
Figure 1:
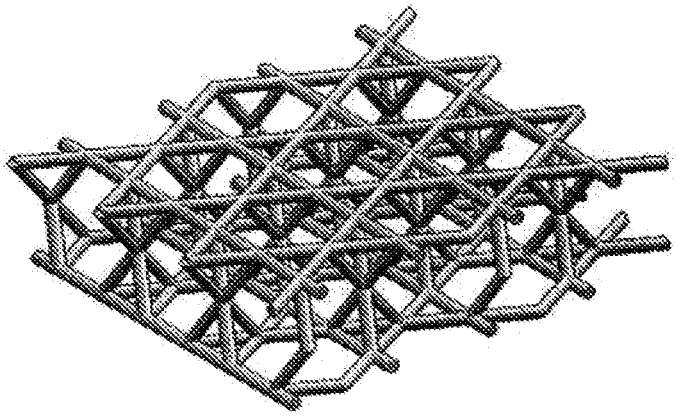
Figure 2:
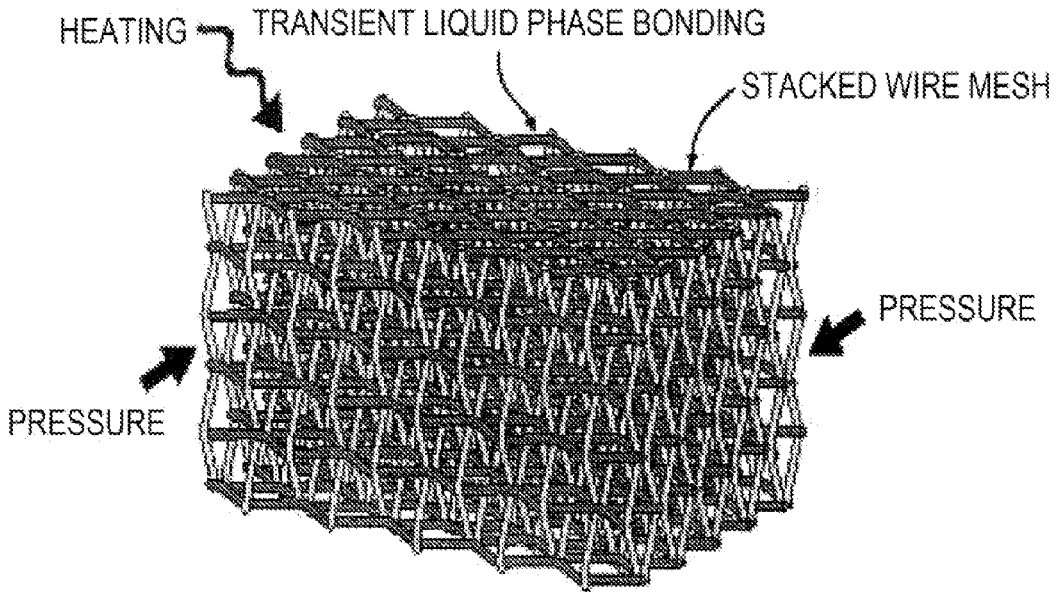
FIGS. 2 to 5 are views of a 3D lightweight structure according to a related art.
Figure 3:
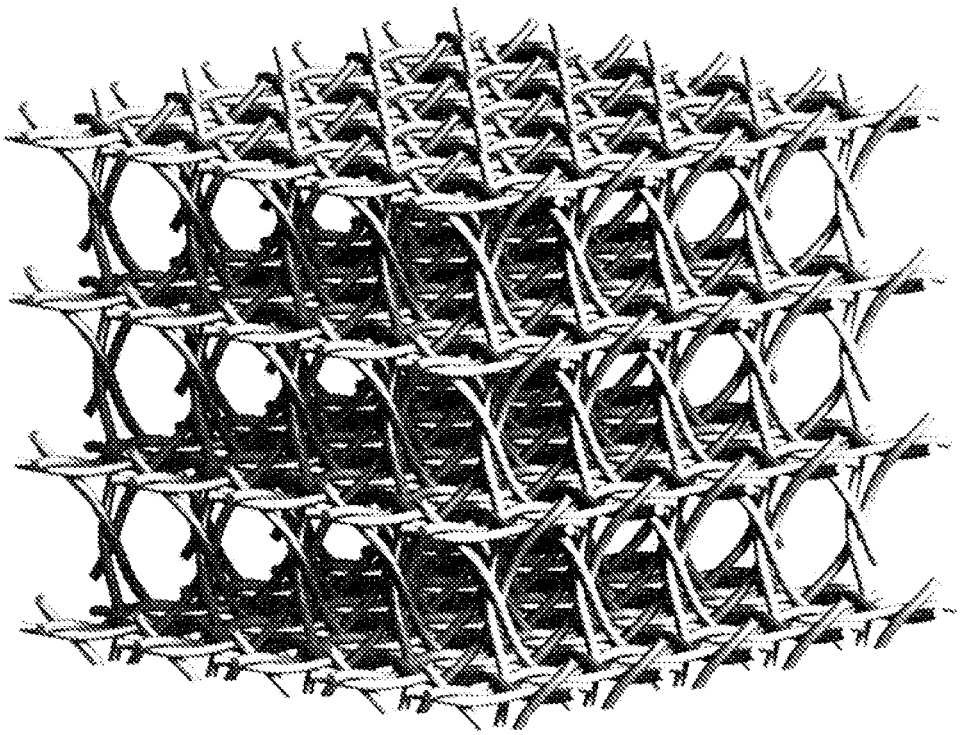
Figure 4:
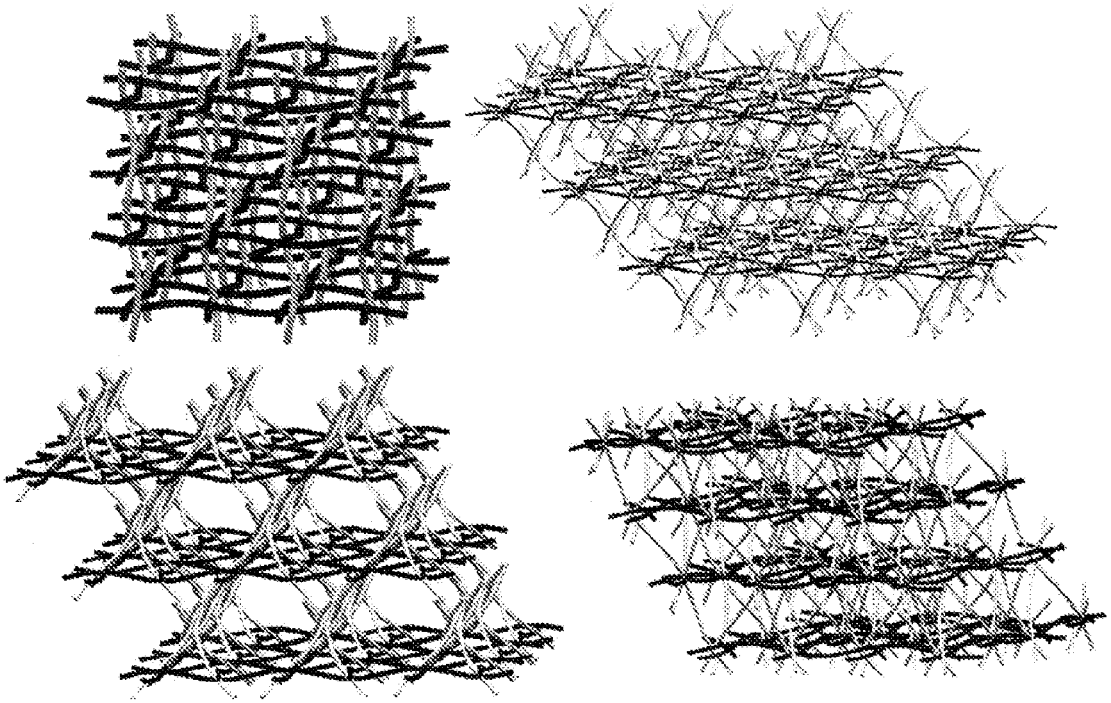
Figure 5:
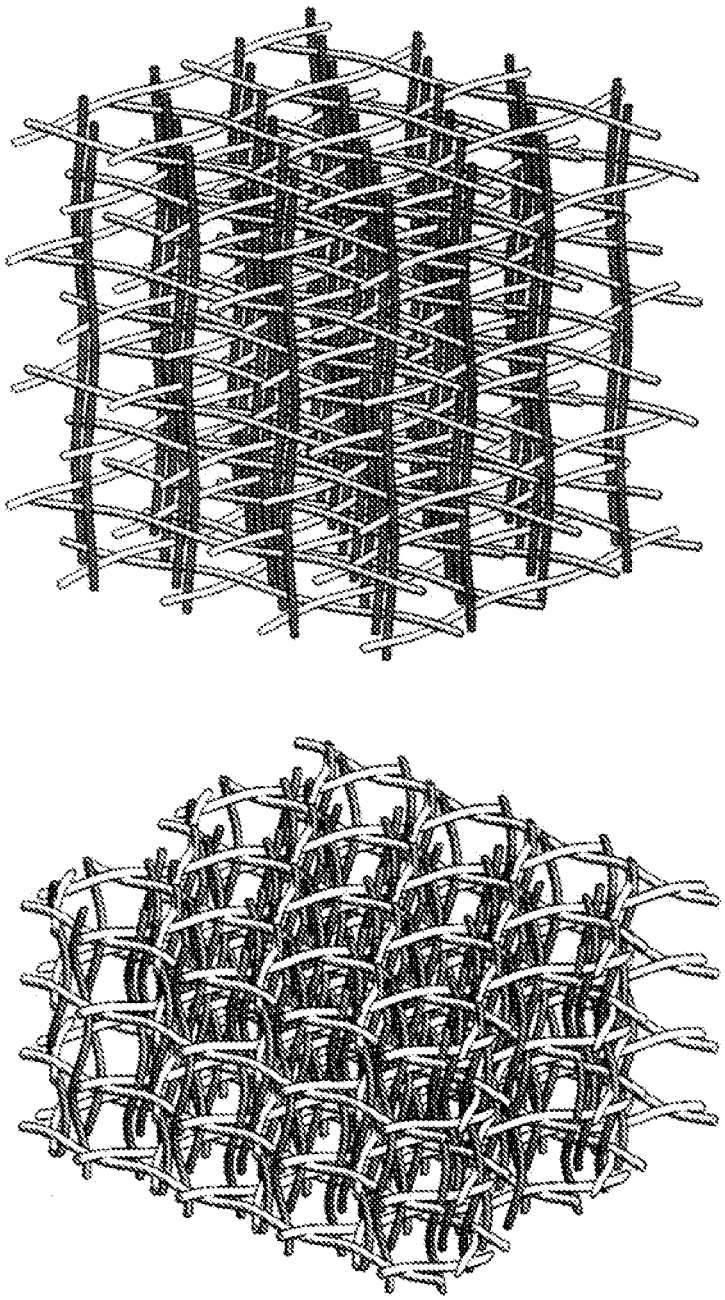
Figure 6:
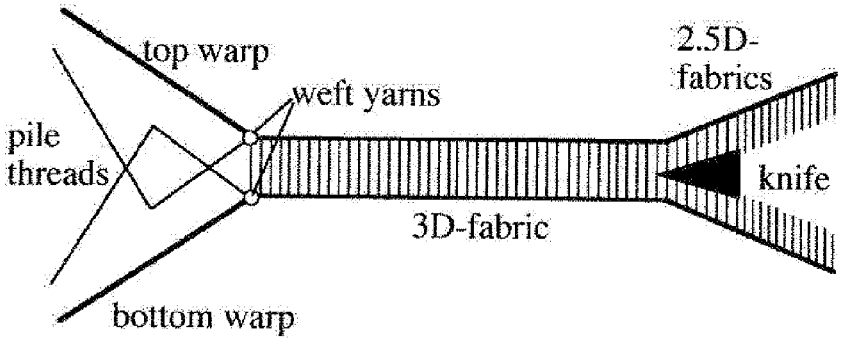
FIG. 6 is a schematic view (a) illustrating a process for manufacturing a sandwich panel by using a weaving manner according to the related art and a photograph (b) of a sandwich panel manufactured through the process.
Figure 6:
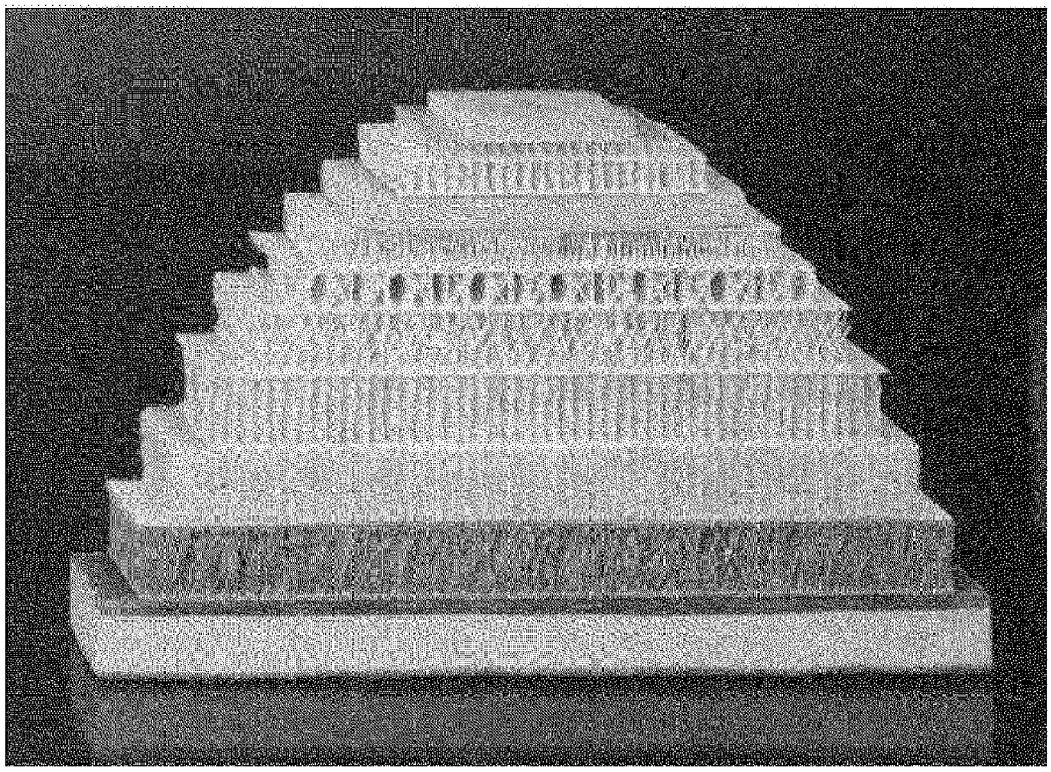

Exemplary embodiments of the present invention will be described below in more detail with reference to the accompanying drawings. Throughout the drawings, equal or similar reference numerals are used to denote equal or similar components, and the terms "comprising", "including", and "having" are intended to be inclusive and mean that there may be additional elements other than the listed elements.

In the drawings which illustrate each of embodiments of the present invention, a plane defined by upper and lower face sheets of a sandwich panel is defined as an x-y panel, and an axis perpendicular to the face sheets is defined as a z-axis. Here, the virtual z-axis may correspond to a length direction of a support shaft described in the embodiments. Also, with regard to a horizontal moving direction of each of the face sheets or an insertion angle of a wire, when a direction of the z-axis inclined with respect to an x-axis or a y-axis is a clockwise direction, the direction of the z-axis will be defined as a positive direction. On the other hand, when the direction of the z-axis is a counterclockwise direction, the direction of the z-axis will be defined a negative direction.

First Embodiment

Figure 7:
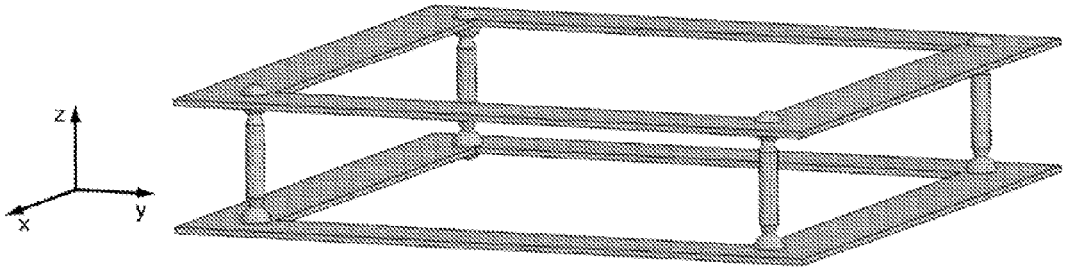
FIGS. 7 to 21 are views illustrating a method for manufacturing a panel according to a first embodiment of the present invention.

FIG. 7 is a view illustrating an example of a support that is capable of being used in a process of manufacturing a sandwich panel according to a first embodiment and a second embodiment that will be described later. The support includes rectangular upper and lower frames and a support shaft vertically connecting the frames to each other at four edges of each of the frames. Here, the support shaft and each of the frames may be connected to each other by using a ball joint. The ball joint may be adequately fixed to maintain the present configuration of the support before an external predetermined force or more is applied thereto. Also, for convenience of description with respect to the movement of the face sheets or the sewing direction, as shown in FIG. 7, three-axial directions x, y, and z which are perpendicular to each other are defined.

Figure 8:
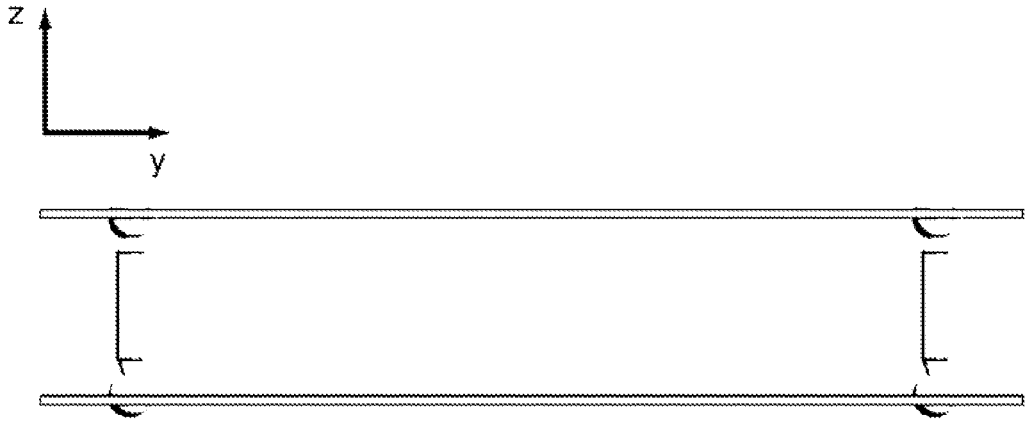

First, a face sheet is attached to each of the upper and lower frames to manufacture a complex. FIG. 8 is a view of the complex on a y-z plane in a state where the face sheets is attached thereto. However, since the upper and lower frames are integrated with the face sheets when the panel is manufactured, for convenience of description and understanding, the upper and lower frames will be omitted in the following drawings.

Figure 9:
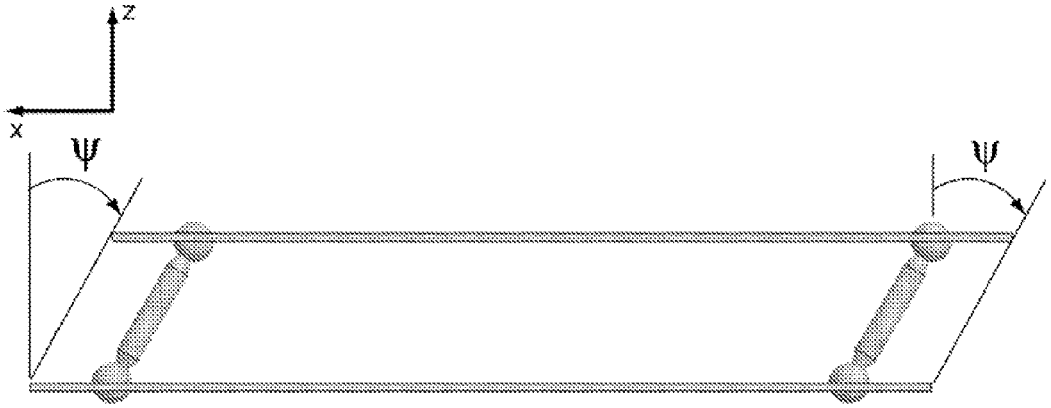
Figure 10:
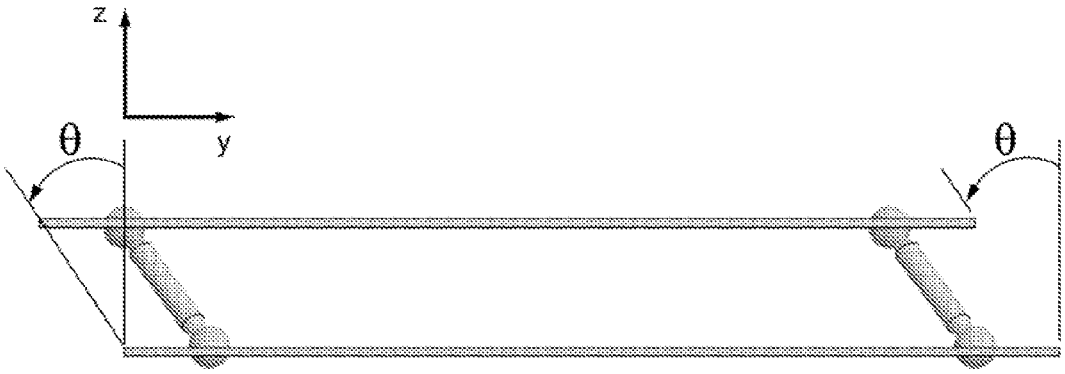

Next, the upper and lower face sheets move in parallel to each other so that the support shaft rotates on an x-z plane at a predetermined angle $\psi$ in a clockwise direction (see FIG. 9). Then, in a state where the upper and lower face sheets move in parallel to each other so that the support shaft rotates on the y-z plane at a predetermined angle $\theta$ in a counterclockwise direction (see FIG. 10), a flexible wire passes through the upper and lower face sheets to reciprocation-sew the upper and lower face sheets. In this case, a sewing distance yo may be equal to a y-axis component of a displacement between the upper and lower face sheets. In a state where an x coordinate is fixed, the face sheets are sewed from one ends thereof to the other ends in a y-axis direction to form a sewing row. When the sewing position reaches ends of the face sheets, the sewing position moves by a predetermined distance xo in the x-axis direction, and then, a sewing start point is displaced by half of the sewing distance yo to sew the face sheets in a reverse direction. In this case, the sewing distance xo may be equal to an x-axis component of the displacement between the upper and lower face sheets. When the sewing position reaches an opposite end, the x coordinate and the sewing start point are adjusted to repeatedly perform the sewing process. The above-described sewing process is called a "primary sewing".

Figure 11:
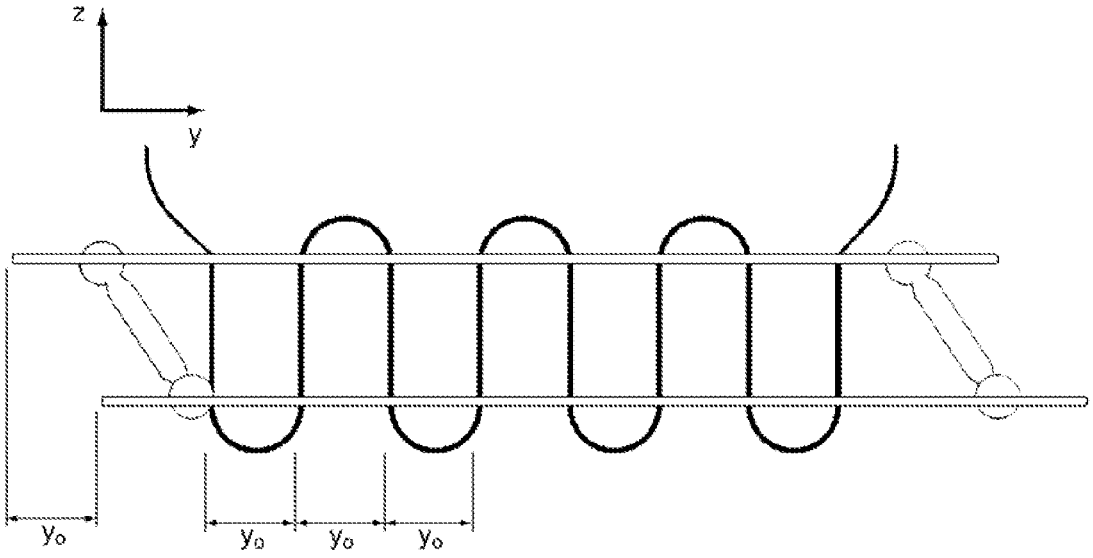
Figure 12:
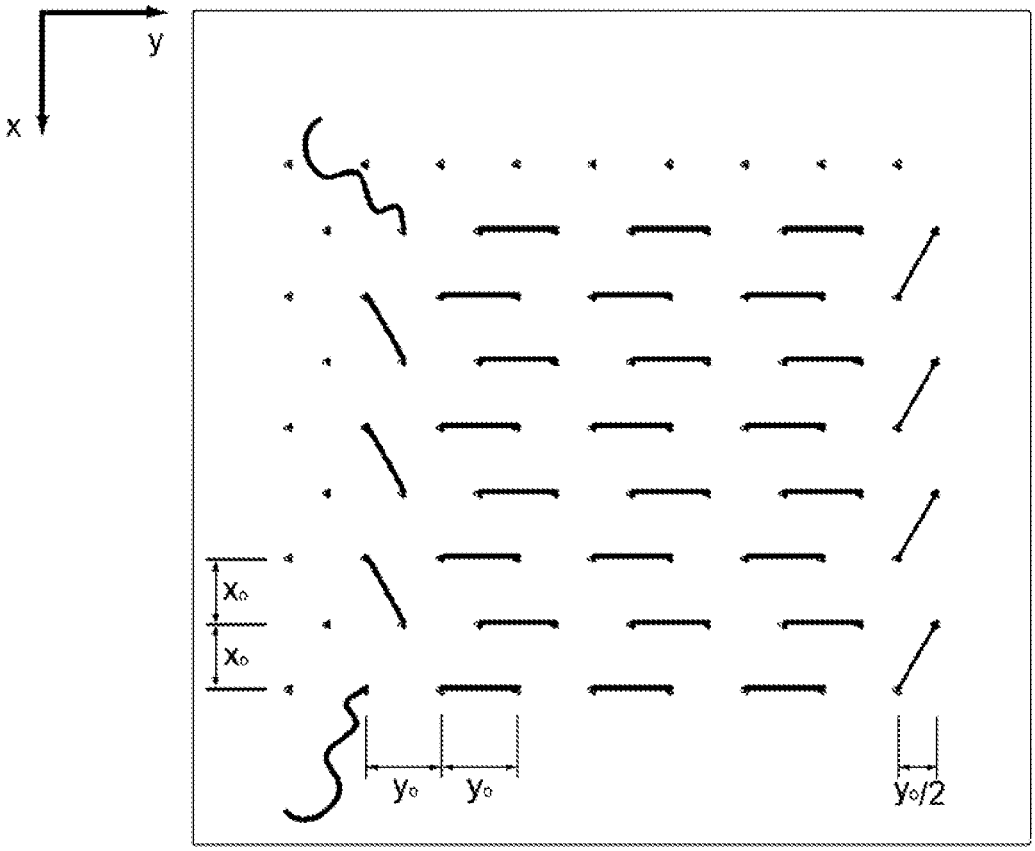

FIG. 11 is a view of a configuration on a y-z plane after the sewing is performed once from a left end to a right end in the state where the x coordinate is fixed in the initial stage of the primary sewing. A wire sewed in a vertical direction is disposed between the face sheets. FIG. 12 is a view illustrating an arrangement of the wire on the upper face sheet after the primary sewing is finished. To smoothly move the face sheets in parallel to each other in a next process when the primary sewing is performed, the flexible wire exposed to upper and lower sides of each of the upper and lower face sheets protrudes by a predetermined length.

Figure 13:
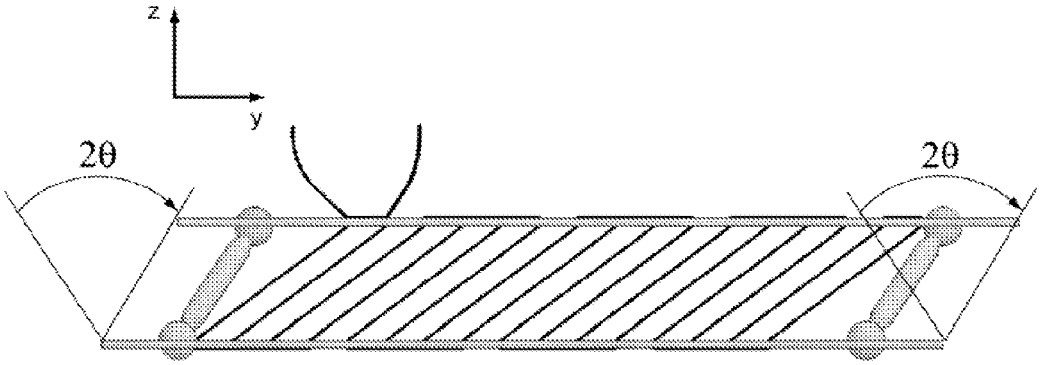

In the next process, the upper and lower face sheets move in parallel to each other so that the support shaft rotates on the y-z planes at a predetermined angle 2θ in the clockwise direction. Thus, the support shaft may be inclined at an angle θ in a direction exactly opposite to that of FIG. 10 (see FIG. 13). Then, a sewing process, like the "primary sewing" is repeated. In this case, a position of a point passing through the face sheets may be equal to that of the "primary sewing". The above-described sewing process is called a "secondary sewing".

Figure 14:
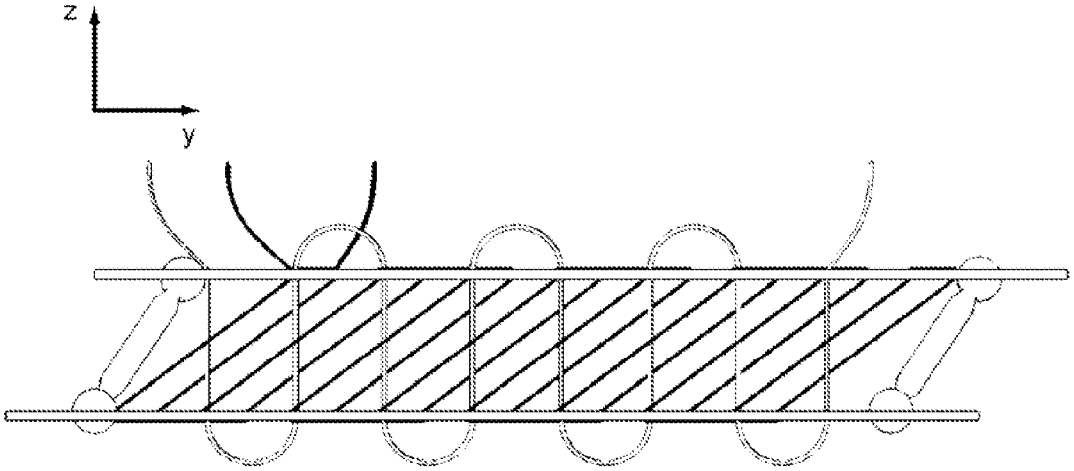
Figure 15:
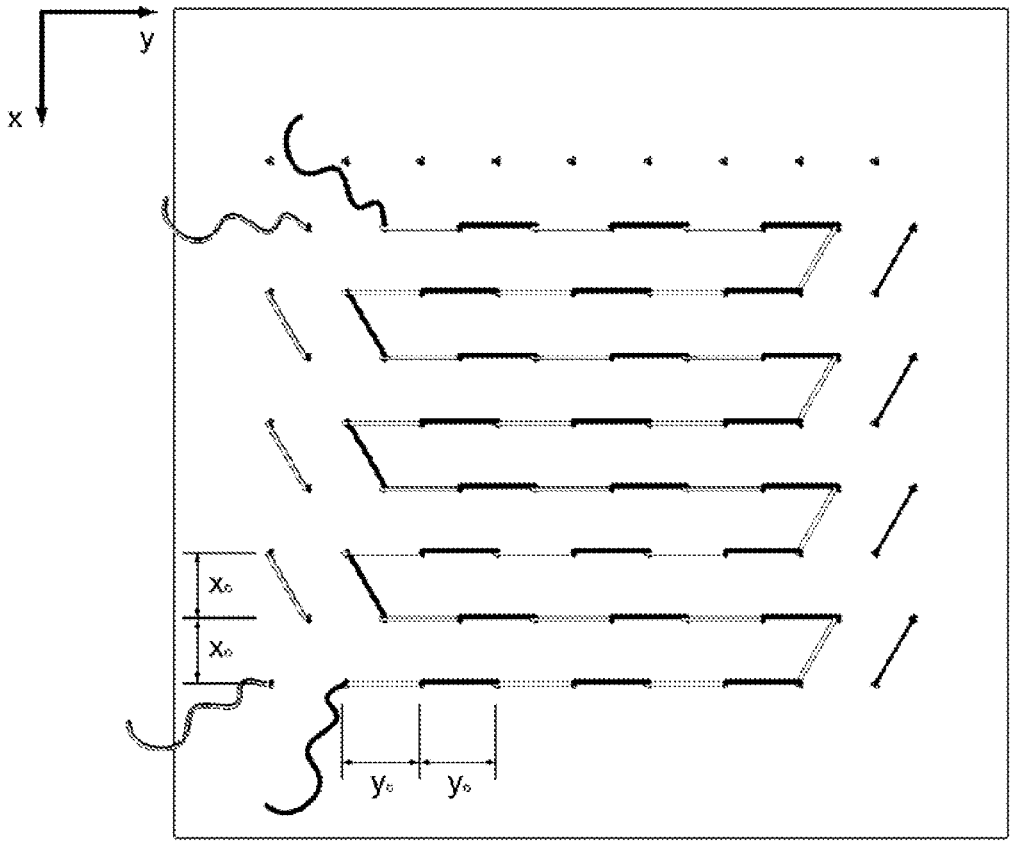
Figure 16:
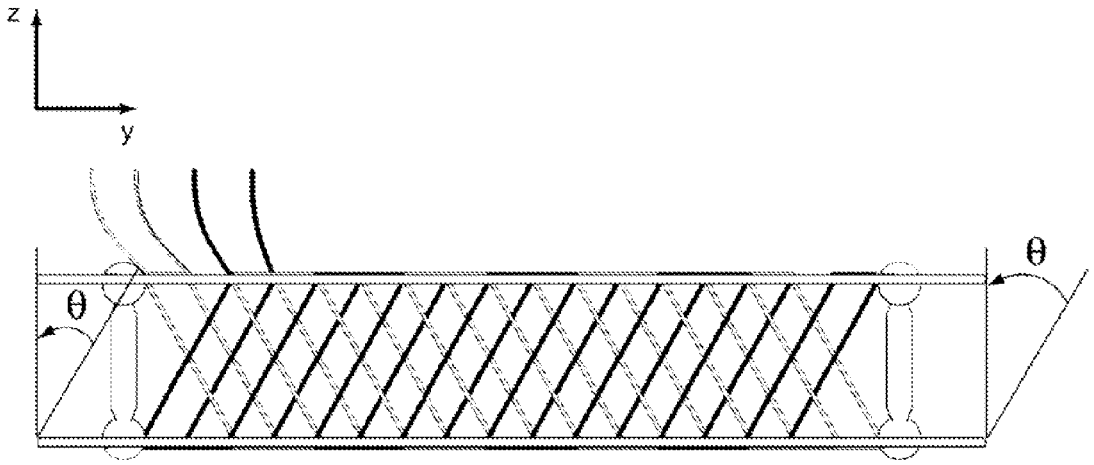

FIG. 14 is a view of a configuration on the y-z plane after the sewing is performed once from a left end to a right end in the state where the x coordinate is fixed in the initial stage of the "secondary sewing". FIG. 15 is a view illustrating an arrangement of the wire on the upper face sheet after the "secondary sewing" is finished. To smoothly move the face sheets in parallel to each other in a next process when the primary sewing is performed, the flexible wire protrudes by a predetermined length to upper and lower sides of each of the upper and lower face sheets. After the secondary sewing is finished, the upper and lower face sheets move in parallel to each other so that the support shaft rotates on the y-z planes at a predetermined angle θ in the counterclockwise direction. FIG. 16 is a view of a configuration in which the wires inserted during the "primary sewing" and the "secondary sewing" are inclined by angles −θ and +θ with respect to a vertical line (the z-axis direction), respectively, when viewed from an upper side of the y-z plane.

Figure 17:
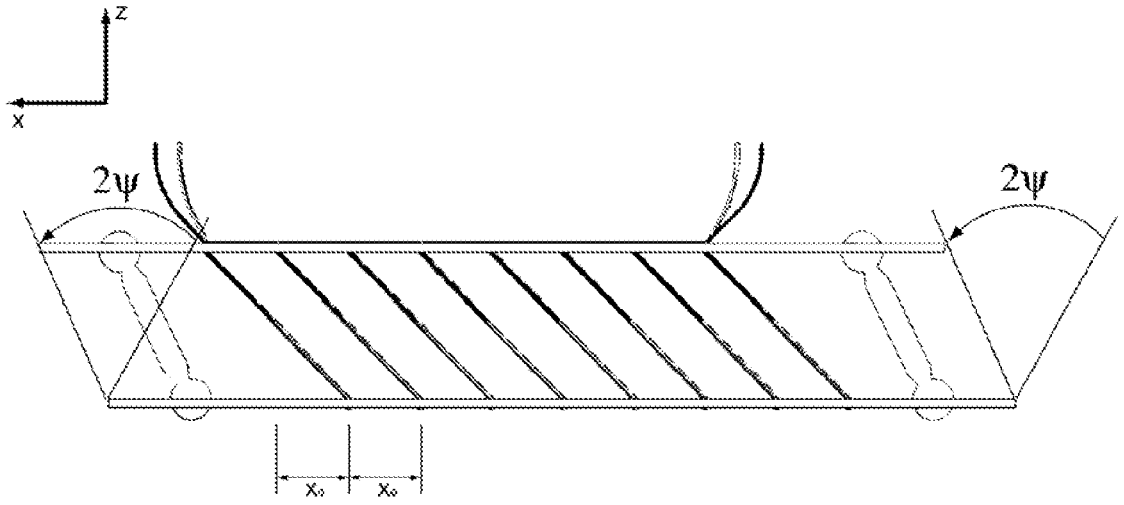

In the next process, the upper and lower face sheets move in parallel to each other so that the support shaft rotates on the x-z planes at a predetermined angle $\mathbf{2}_{\psi}$ in the counterclockwise direction (see FIG. 17). The face sheets are sewed from one end on the y-axis in the x-axis direction. In a state where a sewing distance may be maintained to a certain distance 2*xo*, and a y coordinate may be fixed, the face sheets are straightly sewed from one ends thereof to the other ends in the x-axis direction. When the sewing position reaches ends of the face sheets, the sewing operation pauses, and then a y coordinate increases by a predetermined value yo/2. Then, a sewing start point is displaced by half of the sewing distance xo to sew the face sheets in a reverse direction. When the sewing position reaches an opposite end, the y coordinate and the sewing start point are adjusted to repeatedly perform the sewing process. The above-described sewing process is called a "tertiary sewing".

Figure 18:
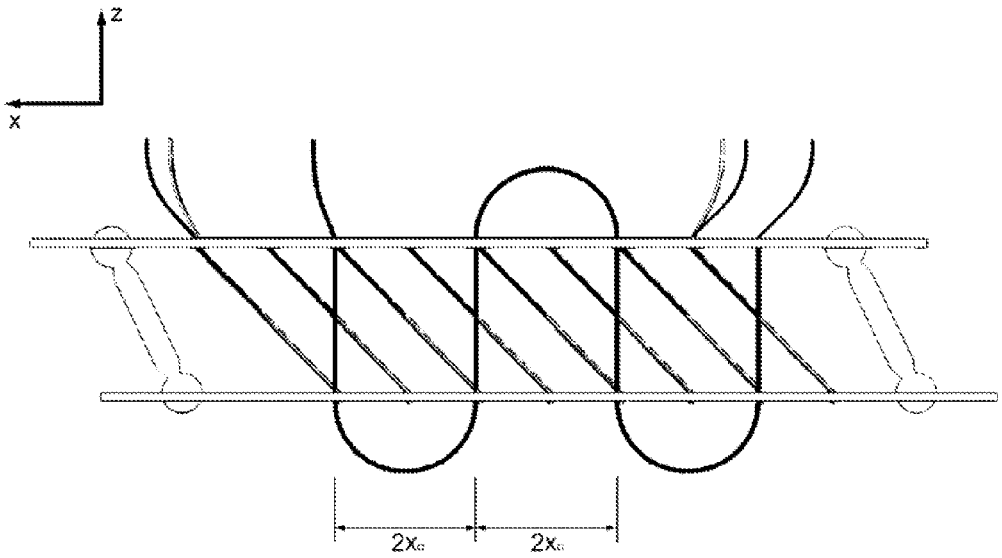
Figure 19:
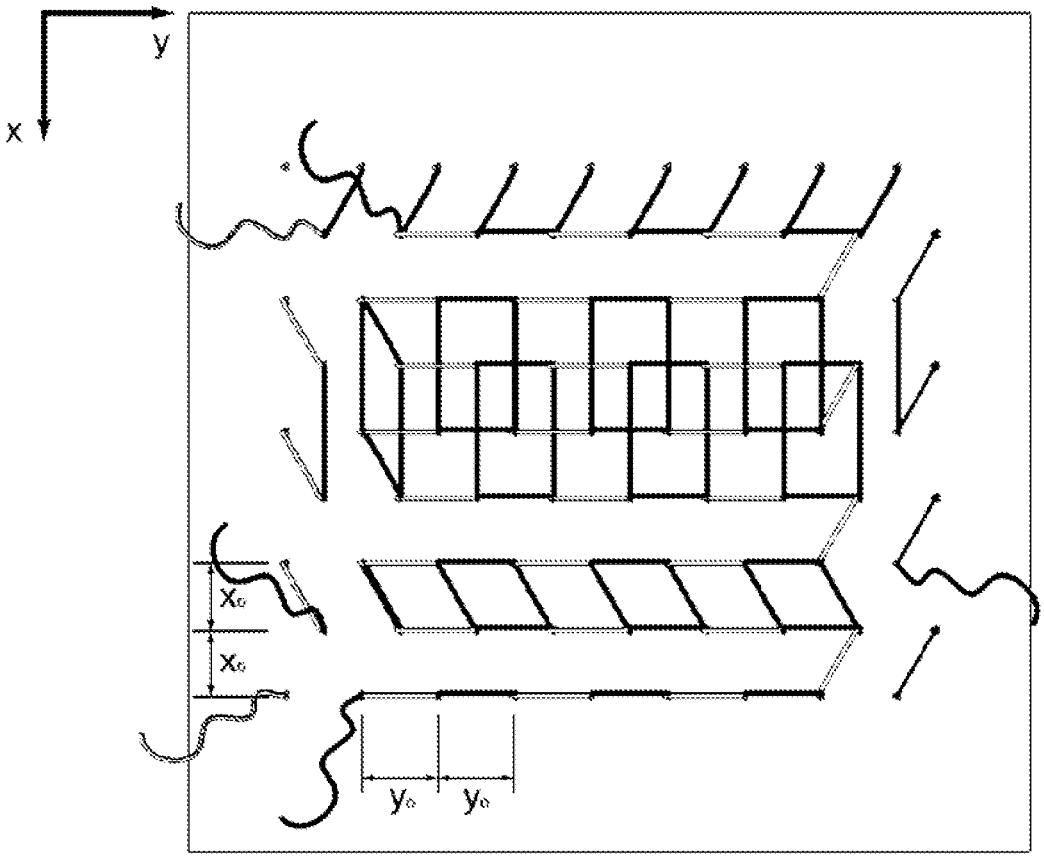
Figure 20:
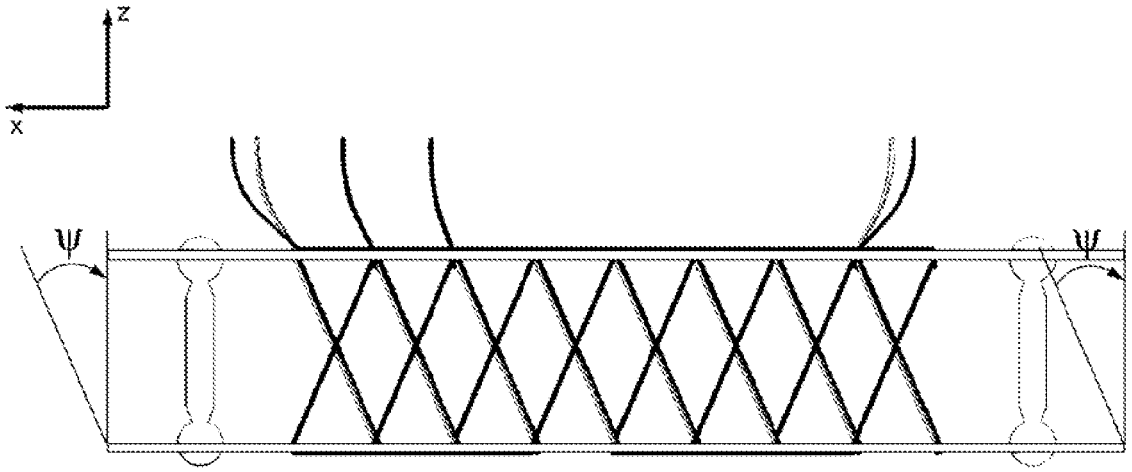

FIG. 18 is a view of a configuration on the x-z plane after the sewing is performed once from a left end to a right end in the state where the y coordinate is fixed in the initial stage of the "tertiary sewing". FIG. 19 is a view illustrating an arrangement of the wire on the upper face sheet after the "tertiary sewing" is finished. To smoothly move the face sheets in parallel to each other in a next process when the "tertiary sewing" is performed, the flexible wire exposed to upper and lower sides of each of the upper and lower face sheets protrudes by a predetermined length. After the tertiary sewing is finished, the upper and lower face sheets move in parallel to each other so that the support shaft rotates on the x-z planes at a predetermined angle ψ in the clockwise direction, thereby allowing the support shaft to be perpendicular to the face sheets. Thus, the displacement between the upper and lower face sheets may be solved. FIG. 20 is a view of a configuration in which the wires inserted during the primary sewing and the secondary sewing and the wire inserted during the tertiary sewing are inclined by angles −ψ and +ψ with respect to the vertical line (the z-axis direction), respectively, when viewed from an upper side of the x-z plane.

Lastly, the support shaft between the upper and lower face sheets is separated, and then the upper and lower face sheets extends in directions opposite to each other so that both face sheets are away from each other. Then, in a state where the wires loosely arranged above the upper face sheet and under the lower face sheet and the wires inserted between the upper and lower face sheets are straightly pulled in parallel to each other during the sewing process of the wires, contact parts between the wires and the upper and lower face sheets are fixed.

Figure 21:
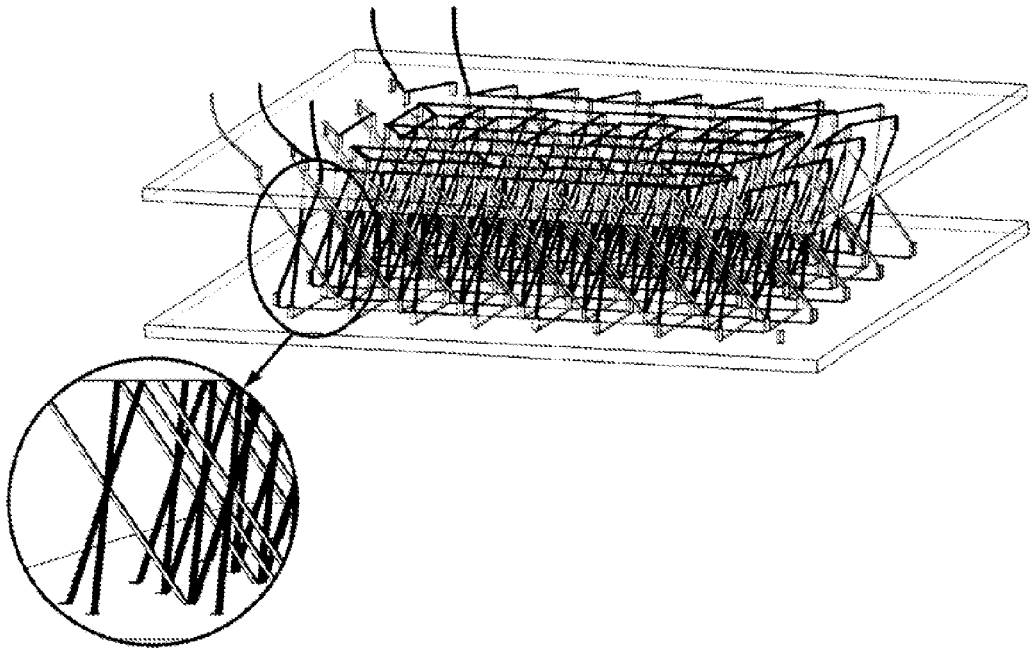

In case where a core is formed of a flexible wire (e.g., a metal) having a predetermined stiffness in itself, satisfied compression, shearing, and bending strength to weight ratio on the basis of the stiffness of the wire in itself and mechanical structure of the truss may be achieved. If the core is formed of a wire material having an insufficient stiffness in itself such as a uni-directional yarn, a 3-D truss structure may be formed by using a semi-cured wire in which a coupling material such as a resin is previously impregnated to cure the 3-D truss structure. Alternatively, a 3-D truss structure may be formed, and then, a separate resin may be sprayed to impregnate the 3-D truss structure in the resin, thereby curing the 3-D truss structure. As a result, the face sheet contact parts, the wire, and wire crossing parts may be fixed at the same time to manufacture an economical and high-strength sandwich panel having a simple structure. Particularly, in case where the wire material includes carbon and glass yarn, a 3D truss structure may be formed in a semi-cured state in which a coupling material such as a resin is previously impregnated to cure the 3D truss structure. Alternatively, a 3D truss structure may be formed, and then, separate liquid syntactic resin bond such as epoxy may be sprayed or coated, or the 3D truss structure is impregnated into the liquid syntactic resin bond to cure the 3D truss structure. FIG. 21 is a view of the sandwich panel manufactured through the above-described process. The core may have a structure in which edges of two-layered 3D octet trusses face each other.

Second Embodiment

Figure 22:
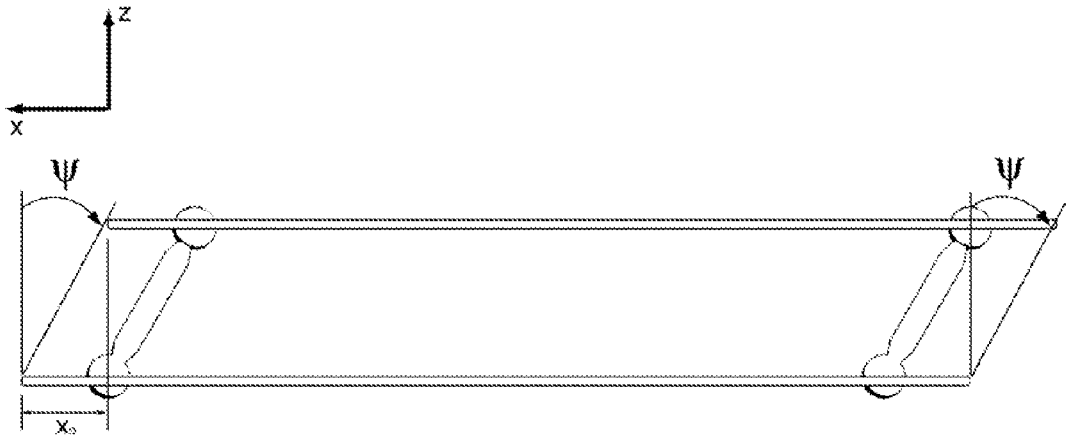
FIGS. 22 to 35 are views illustrating a method for manufacturing a panel according to a second embodiment of the present invention.
Figure 23:
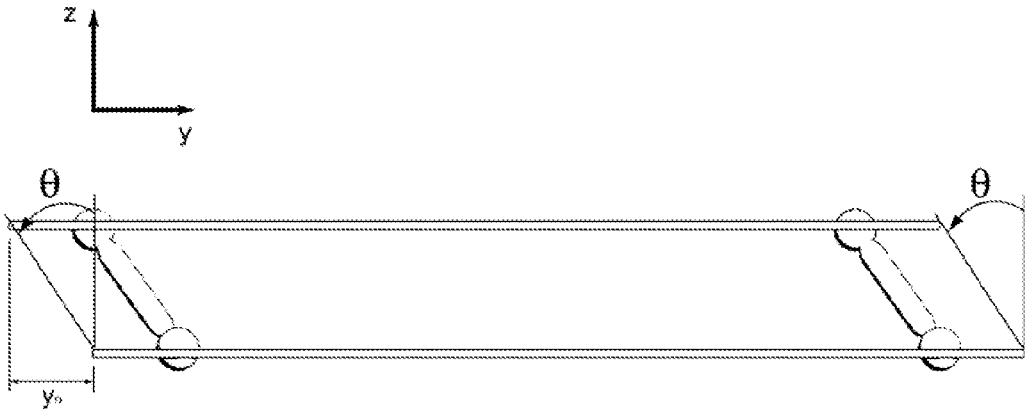
Figure 24:
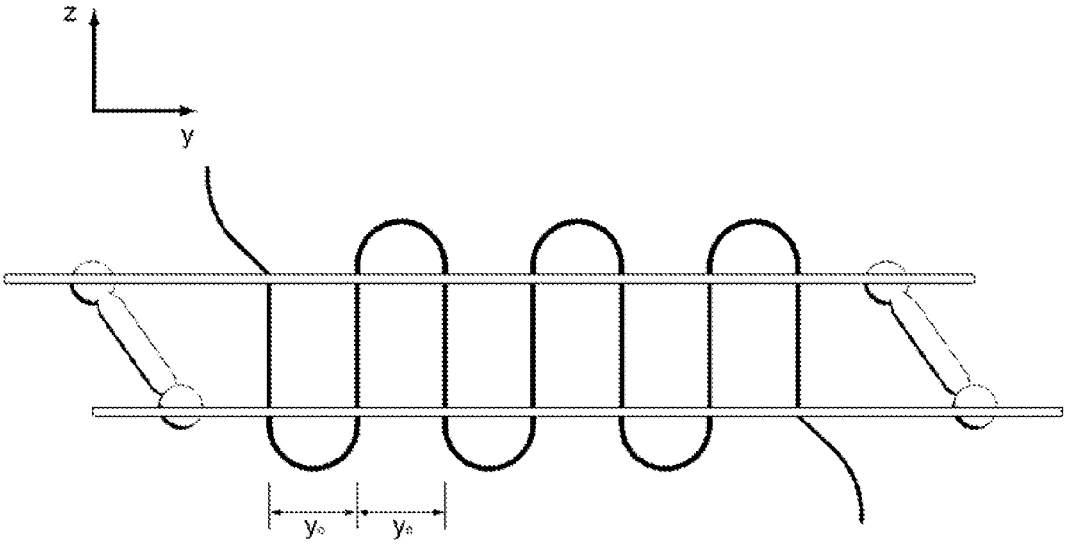
Figure 25:
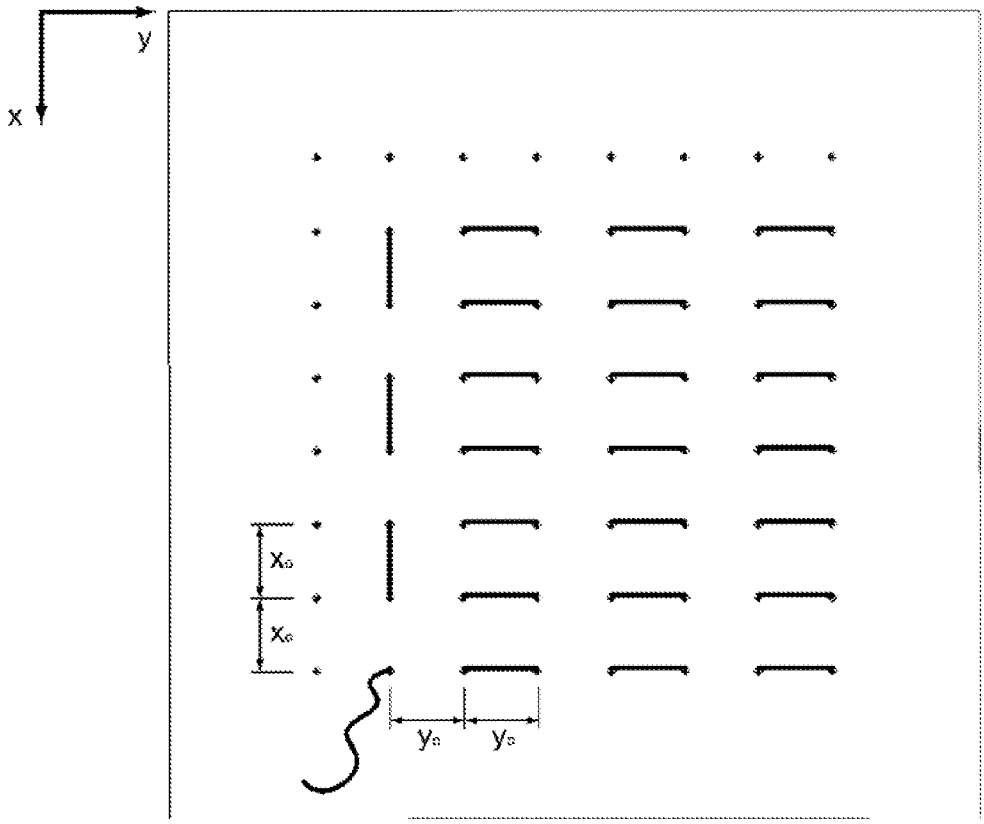

First, upper and lower face sheets move in parallel to each other so that a support shaft rotates on an x-z plane at a predetermined angle ψ in a clockwise direction (see FIG. 22). Next, the upper and lower face sheets move in parallel to each other so that the support shaft rotates on the y-z plane at a predetermined angle θ in a counterclockwise direction (see FIG. 23). The structure illustrated in FIGS. 22 and 23 is the same as that illustrated in FIGS. 9 and 10. A flexible wire passes through upper and lower face sheets to reciprocation-sew the upper and lower face sheets. Here, a sewing distance yo may be equal to a y-axis component of a displacement between the upper and lower face sheets due to parallel movement of the upper and lower face sheets. In a state where an x coordinate is fixed, the face sheets are sewed from one ends thereof to the other ends in a y-axis direction. Then, when the sewing position reaches ends of the face sheets, the sewing operation pauses, and then the x coordinate increases by a predetermined value xo. Thereafter, the face sheets are reversely sewed in a direction parallel to the y-axis direction. In this case, the sewing distance xo may be equal to an x-axis component of the displacement between the upper and lower face sheets. When the sewing position reaches an opposite end, the x coordinate is adjusted to repeatedly perform the sewing process. The above-described sewing process is called a "primary sewing". FIG. 24 is a view of a configuration on the y-z plane after the sewing is performed once from a left end to a right end in the state where the x coordinate is fixed in the initial stage of the primary sewing. A wire is vertically disposed between the face sheets. FIG. 25 is a view illustrating an arrangement of the wire on the upper face sheet after the primary sewing is finished. To smoothly move the face sheets in parallel to each other in a next process when the primary sewing is performed, the flexible wire exposed to upper and lower sides of each of the upper and lower face sheets protrudes by a predetermined length.

Figure 26:
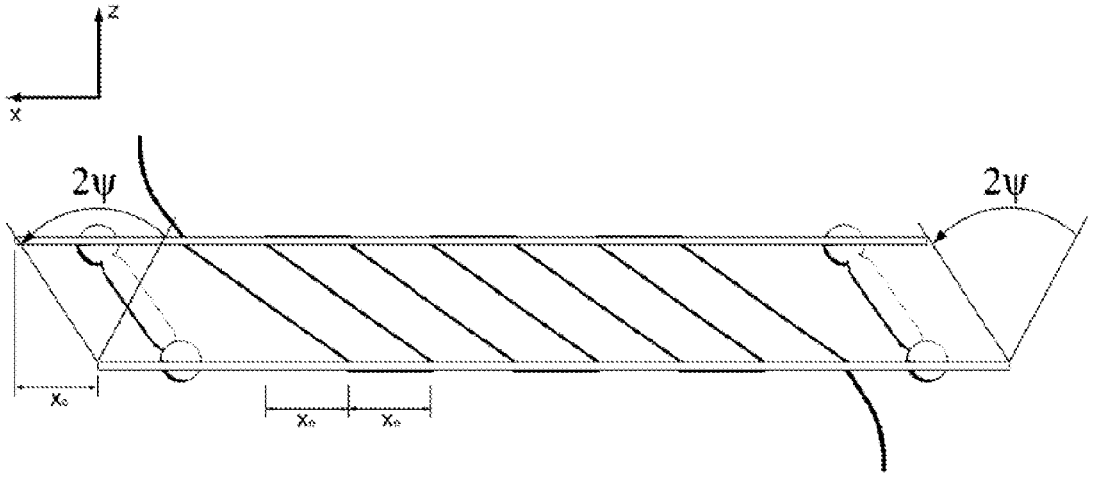
Figure 27:
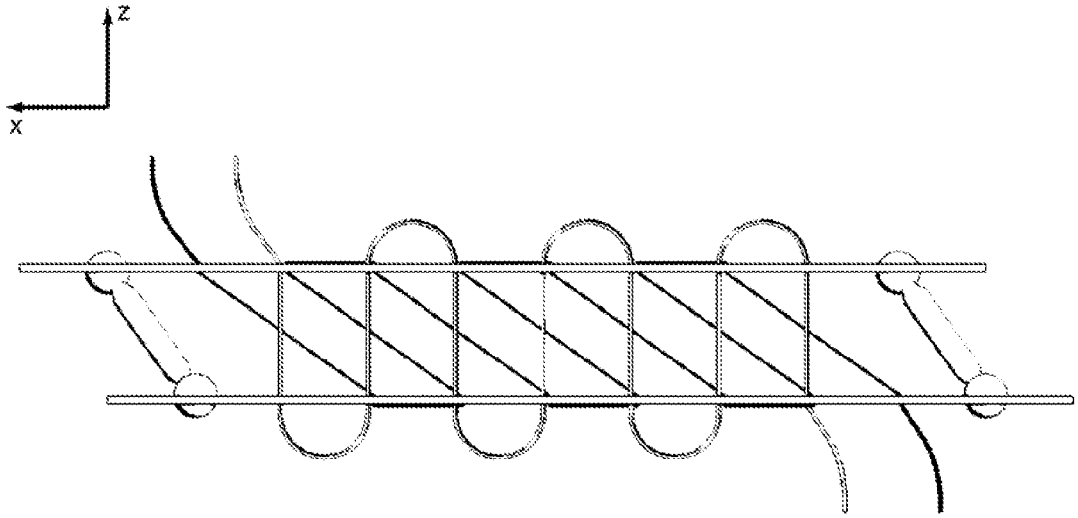
Figure 28:
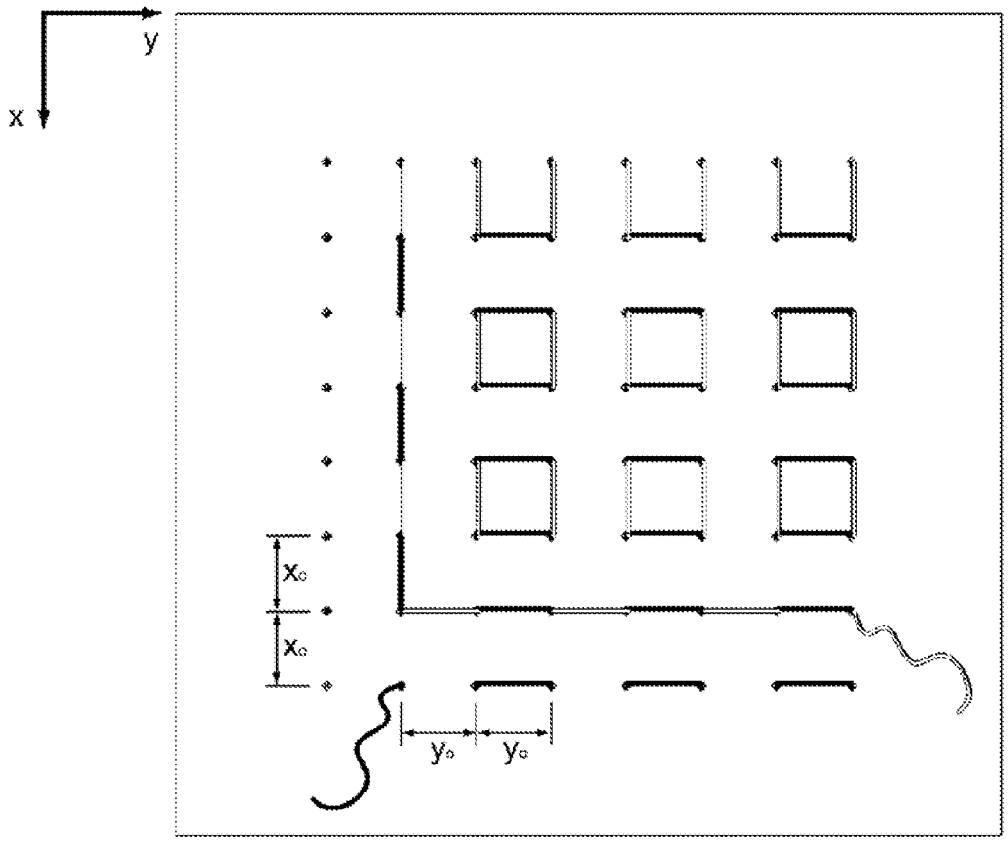

In the next process, the upper and lower face sheets move in parallel to each other so that the support shaft rotates on the x-z planes at a predetermined angle 2ψ in the counterclockwise direction. Thus, the support shaft may be inclined at an angle ψ in a direction exactly opposite to that of FIG. 22 (see FIG. 26). Then, the above-described sewing process is repeated. A position of a point passing through the face sheets is equal to that of the first embodiment. Here, a sewing distance xo may be equal to the x-axis component of a displacement between the upper and lower face sheets due to parallel movement of the upper and lower face sheets. In a state where a y coordinate is fixed, the face sheets are sewed from one ends thereof to the other ends in an x-axis direction. Then, when the sewing position reaches ends of the face sheets, the sewing operation pauses, and then the y coordinate increases by a predetermined value yo. Thereafter, the face sheets are reversely sewed in a direction parallel to the x-axis direction. In this case, the sewing distance yo may be equal to the y-axis component of the displacement between the upper and lower face sheets. When the sewing position reaches an opposite end, the y coordinate is adjusted to repeatedly perform the sewing process. The above-described sewing process is called a "secondary sewing". FIG. 27 is a view of a configuration on the x-z plane after the sewing is performed once from a left end to a right end in the state where the y coordinate is fixed in the initial stage of the secondary sewing. FIG. 28 is a view illustrating an arrangement of the wire on the upper face sheet after the secondary sewing is finished. To smoothly move the face sheets in parallel to each other in a next process when the secondary sewing is performed, the flexible wire exposed to upper and lower sides of each of the upper and lower face sheets protrudes by a predetermined length.

Figure 29:
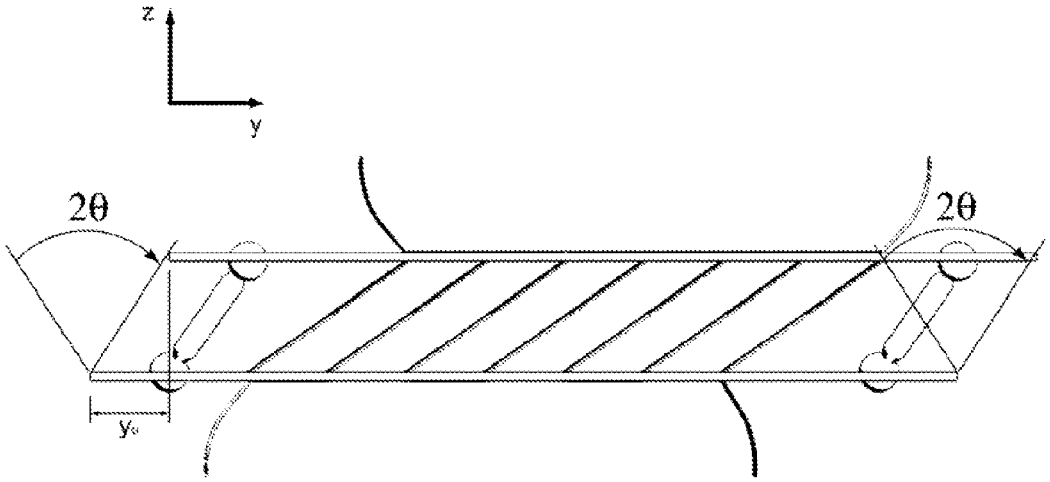
Figure 30:
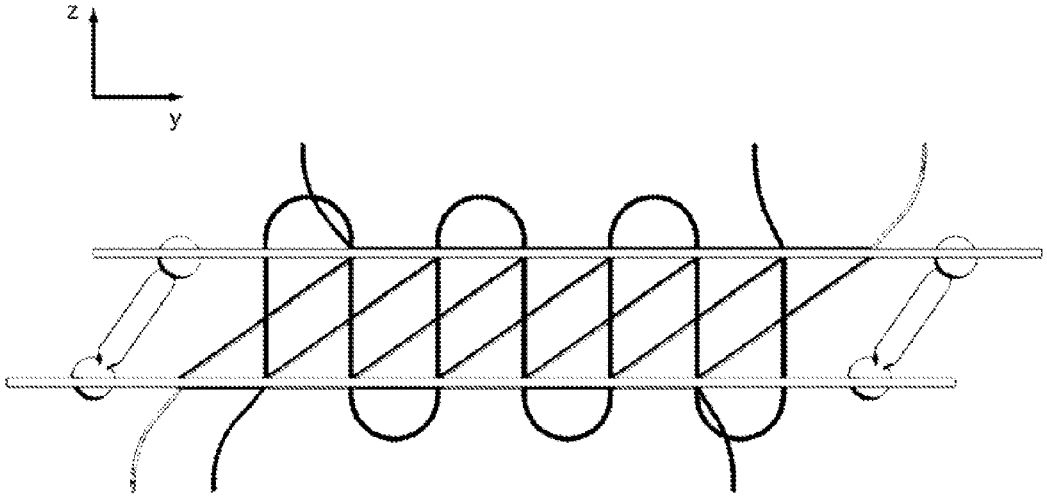
Figure 31:
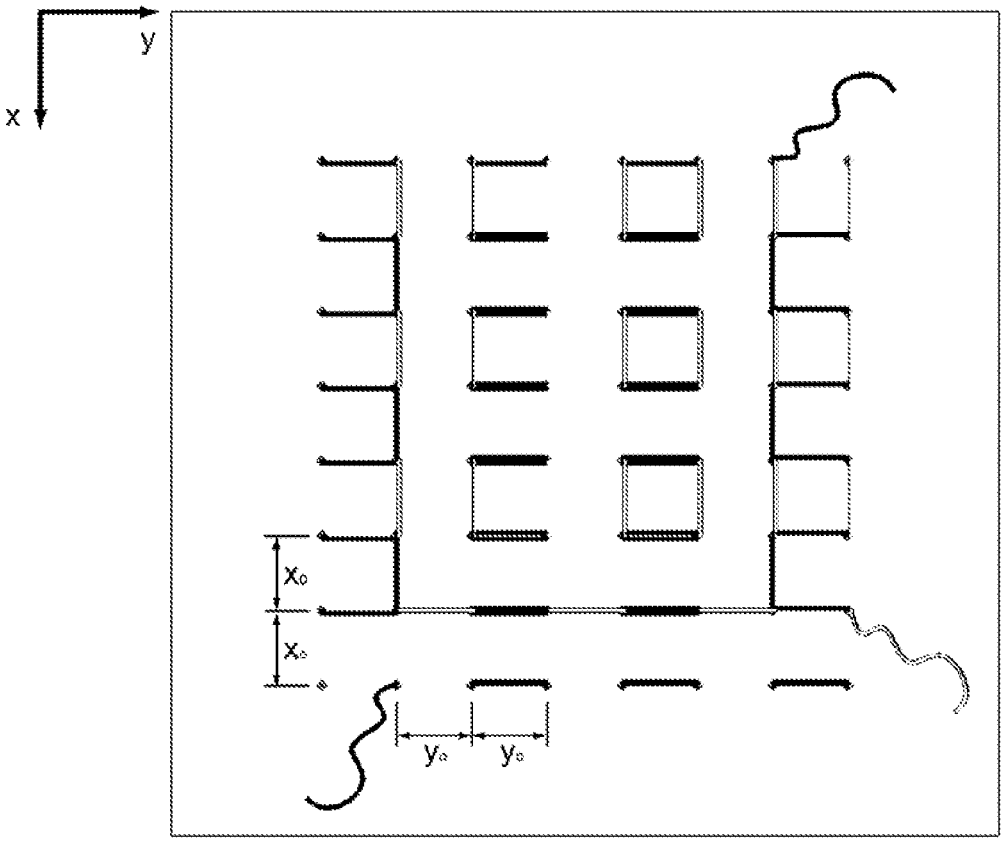

In the next process, the upper and lower face sheets move in parallel to each other so that the support shaft rotates on the y-z planes at a predetermined angle 2θ in the clockwise direction (see FIG. 29). In a state where the x coordinates of the face sheets are fixed, the face sheets are sewed from a right end to a left end on the y-axis. The face sheets are sewed at a constant sewing distance yo. Then, when the sewing position reaches ends of the face sheets, the sewing operation pauses, and then the x coordinate increases by a predetermined value xo. Thereafter, the face sheets are reversely sewed in a direction parallel to the y-axis direction. When the sewing position reaches an opposite end, the x coordinate is adjusted to repeatedly perform the sewing process in a reverse direction. The above-described sewing process is called a "tertiary sewing". FIG. 30 is a view of a configuration on the y-z plane after the sewing is performed once from a right end to a left end in the state where the x coordinate is fixed in the initial stage of the tertiary sewing. FIG. 31 is a view illustrating an arrangement of the wire on the upper face sheet after the tertiary sewing is finished. To smoothly move the face sheets in parallel to each other in a next process when the tertiary sewing is performed, the flexible wire exposed to upper and lower sides of each of the upper and lower face sheets protrudes by a predetermined length.

Figure 32:
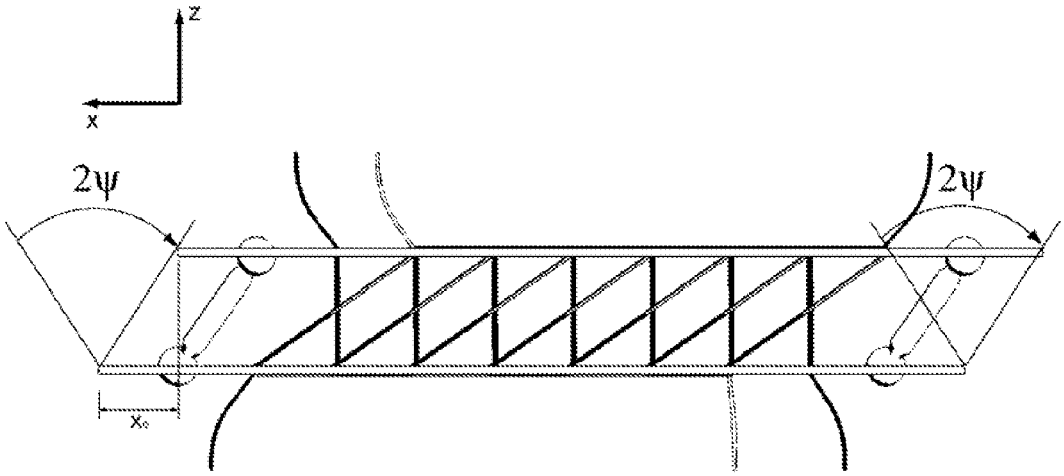
Figure 33:
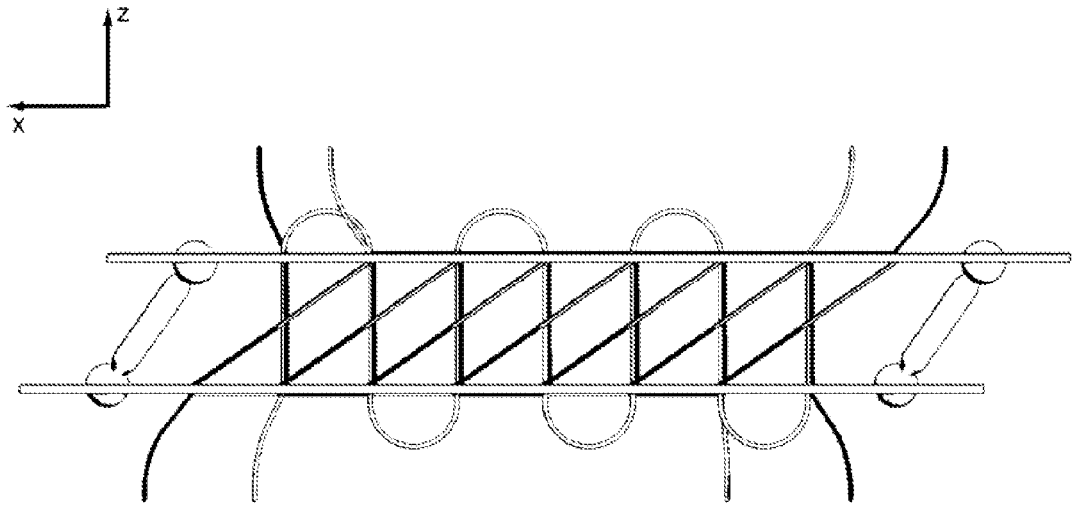
Figure 34:
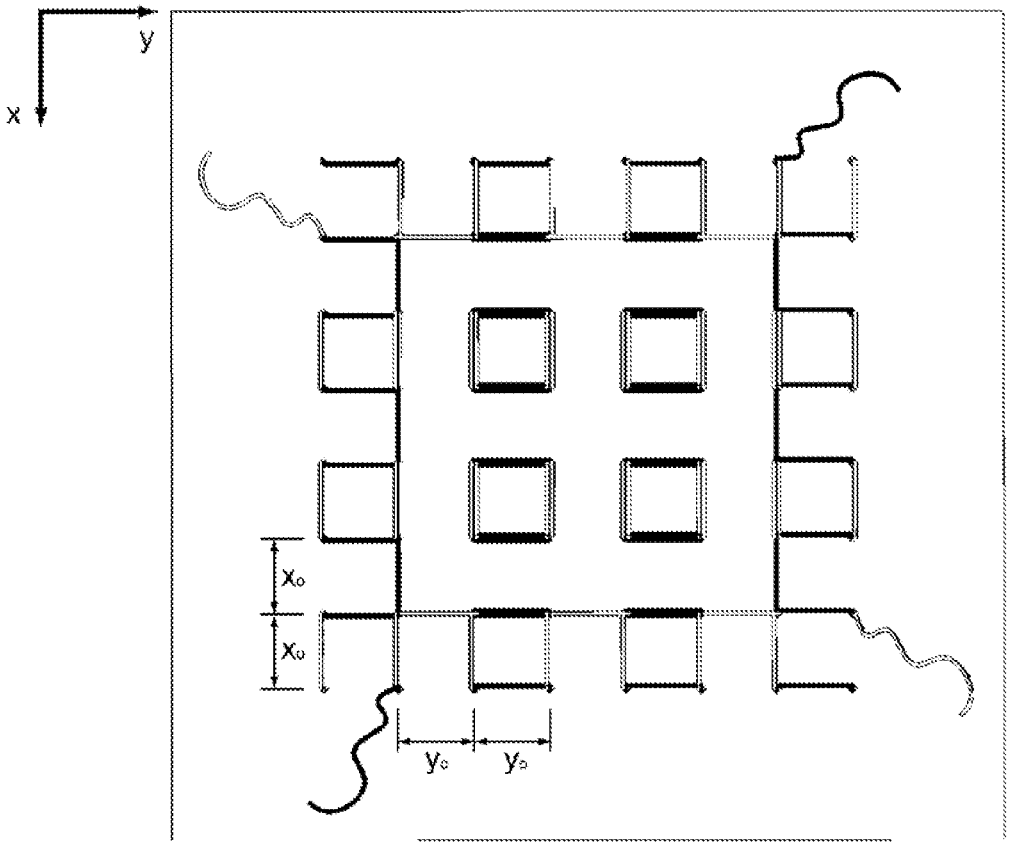

In the next process, the upper and lower face sheets move in parallel to each other so that the support shaft rotates on the x-z planes at a predetermined angle 2ψ in the clockwise direction (see FIG. 32). In a state where the y coordinates of the face sheets are fixed, the face sheets are sewed from a right end to a left end on the x-axis. The face sheets are sewed at a constant sewing distance xo. Then, when the sewing position reaches ends of the face sheets, the sewing operation pauses, and then the y coordinate increases by a predetermined value yo. Thereafter, the face sheets are reversely sewed in a direction parallel to the x-axis direction. When the sewing position reaches an opposite end, the y coordinate is adjusted to repeatedly perform the sewing process in a reverse direction. The above-described sewing process is called a "quartic sewing". FIG. 33 is a view of a configuration on the x-z plane after the sewing is performed once from a right end to a left end in the state where the y coordinate is fixed in the initial stage of the quartic sewing. FIG. 34 is a view illustrating an arrangement of the wire on the upper face sheet after the quartic sewing is finished. To smoothly move the face sheets in parallel to each other in a next process when the quartic sewing is performed, the flexible wire exposed to upper and lower sides of each of the upper and lower face sheets protrudes by a predetermined length. After the tertiary sewing is finished, the upper and lower face sheets move in parallel to each other so that the support shaft rotates on the x-z planes at a predetermined angle ψ in the clockwise direction and at a predetermined angle θ in a counterclockwise direction, thereby allowing the support shaft to be perpendicular to the face sheets. Thus, the displacement between the upper and lower face sheets may be solved.

Lastly, like the first embodiment, the support shaft between the upper and lower face sheets is separated, and then the upper and lower face sheets extends in directions opposite to each other so that both face sheets are away from each other. Then, in a state where the wires loosely arranged above the upper face sheet and under the lower face sheet and the wires inserted between the upper and lower face sheets are straightly pulled in parallel to each other during the sewing process of the wires, contact parts between the wires and the upper and lower face sheets are fixed.

Figure 35:
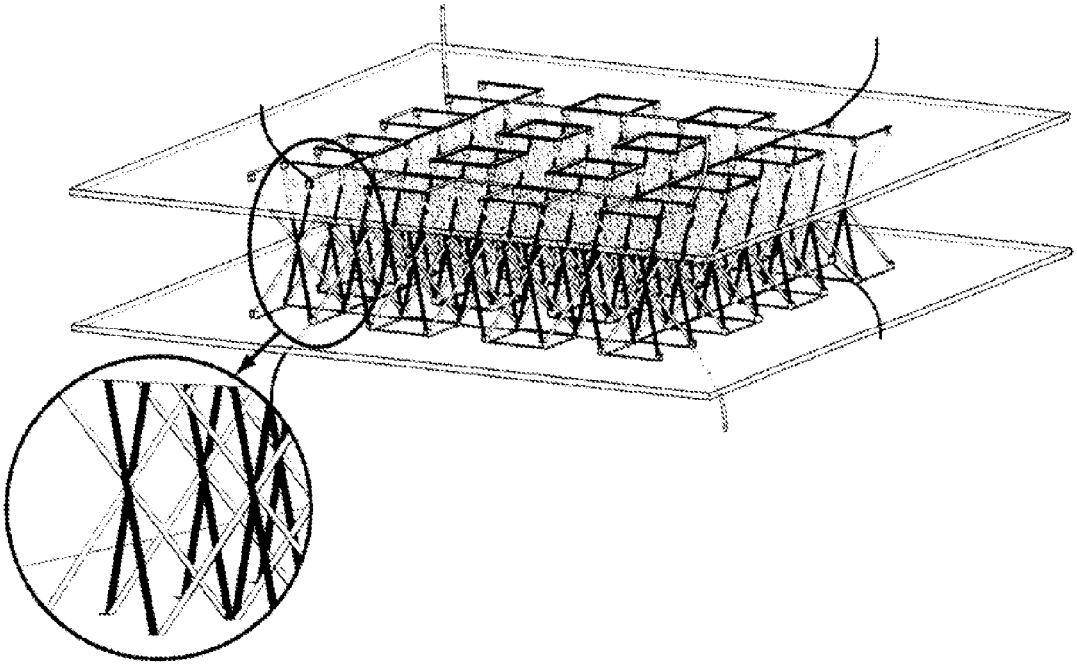

Also, like the foregoing first embodiment, in case where a core is formed of a flexible wire (e.g., a metal) having a predetermined stiffness in itself, satisfied compression, shearing, and bending strength to weight ratio on the basis of the stiffness of the wire in itself and mechanical structure of the truss may be achieved. If the core is formed of a wire material having an insufficient stiffness in itself such as a uni-directional yarn, a 3-D truss structure may be formed by using a semi-cured wire in which a coupling material such as a resin is previously impregnated to cure the 3-D truss structure. Alternatively, a 3-D truss structure may be formed, and then, a separate resin may be sprayed to impregnate the 3-D truss structure in the resin, thereby curing the 3-D truss structure. As a result, the face sheet contact parts, the wire, and wire crossing parts may be fixed at the same time to manufacture an economical and high-strength sandwich panel having a simple structure. Particularly, in case where the wire material includes carbon and glass yarn, a 3D truss structure may be formed in a semi-cured state in which a coupling material such as a resin is previously impregnated to cure the 3D truss structure. Alternatively, a 3D truss structure may be formed, and then, separate liquid syntactic resin bond such as epoxy may be sprayed or coated, or the 3D truss structure is impregnated into the liquid syntactic resin bond to cure the 3D truss structure. FIG. 35 is a view of the sandwich panel manufactured through the above-described process. The core may have a shape in which edges of two-layered trusses having a shape similar to a pyramid shape face each other.

Third Embodiment

Figure 36:
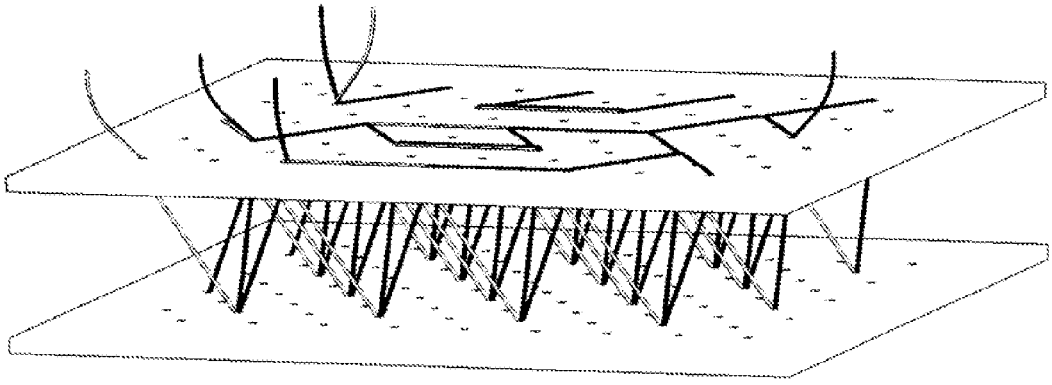
FIGS. 36 and 37 are perspective views of a sandwich panel according to a third embodiment of the present invention.

FIG. 36 is a view of a sandwich panel having a 3D truss core according to a third-1 embodiment of the present invention.

As shown in FIG. 36, the sandwich panel having the 3D truss core according to the third embodiment of the present invention may be a modified example of the sandwich panel according to the foregoing first embodiment of the present invention. That is, a distance between upper and lower face sheets according to the third embodiment may be equal to that between the upper and lower face sheets according to the first embodiment. However, a sewing distance and a spaced distance of a sewing row in a sewing process according to the third embodiment may be double those in the sewing process according to the first embodiment. In this case, the wire core between the upper and lower face sheets may have a shape similar to that of one layer of the 3D octet truss.

Figure 37:
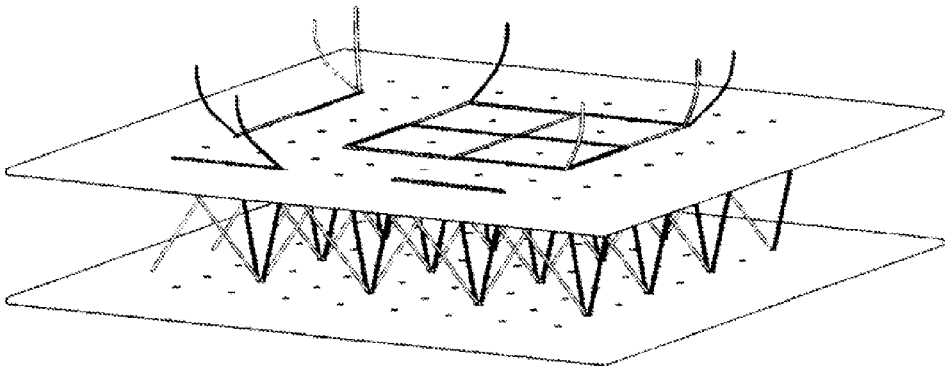
Figure 37:
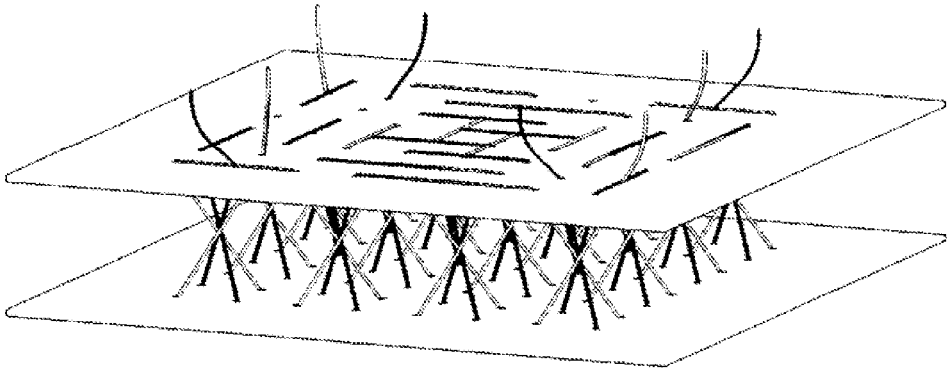

FIG. 37 is a view of a sandwich panel having a modified 3D truss core according to a third embodiment of the present invention.

As shown in FIG. 36, the sandwich panel having the 3D truss core according to the third-2 embodiment of the present invention may be a modified example of the sandwich panel according to the foregoing second embodiment of the present invention. That is, a distance between upper and lower face sheets according to the third embodiment may be equal to that between the upper and lower face sheets according to the second embodiment. However, a sewing distance and a spaced distance of a sewing row in a sewing process according to the third embodiment may be double those in the sewing process according to the second embodiment.

Referring to FIG. 37A, points passing through the face sheets by the sewing are formed regardless of an order of sewing. In this case, a wire core between the upper and lower face sheets may have a shape similar to that of one layer of the 3D pyramid truss. Referring to FIG. 37B, points passing through the face sheets by the secondary to quartic sewing are disposed at a position corresponding to half the distance between the points passing through the face sheets during the primary sewing. In this case, the wire core between the upper and lower face sheets may have a shape similar to that in which one of two 3D trusses of FIG. 35 is omitted.

Fourth Embodiment

Figure 38:
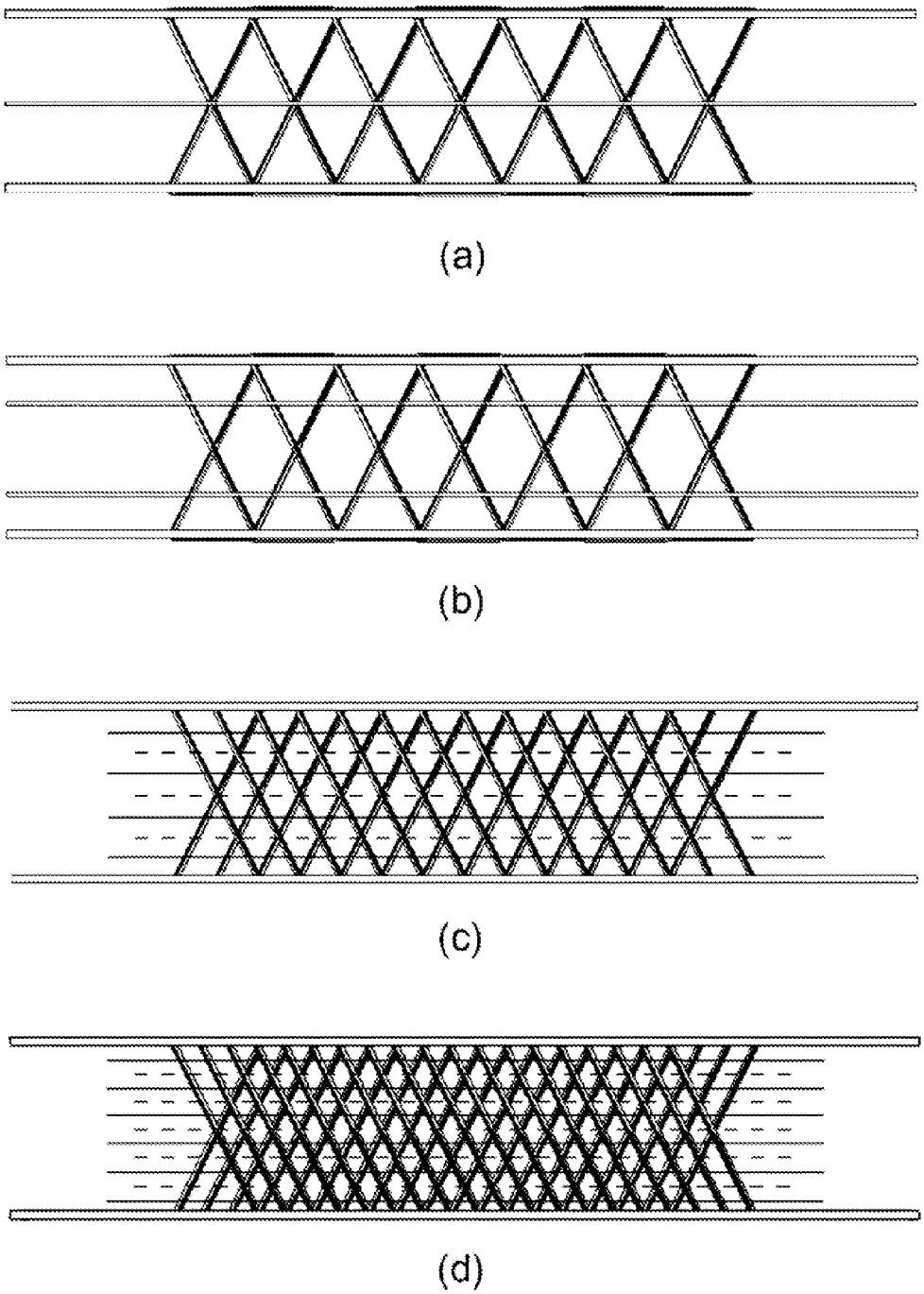
FIG. 38 is a cross-sectional view of a sandwich panel according to a fourth embodiment of the present invention.

FIG. 38 is a view of a sandwich panel having a 3D truss core according to a fourth embodiment of the present invention.

As shown in FIG. 38, a sandwich panel having a 3D truss core according to the fourth embodiment of the present invention may be a modified example of the sandwich panel according to the foregoing first and second embodiments of the present invention. That is, at least one flat plane layer is added between upper and lower face sheets. For convenience of description, FIG. 38 illustrates a two-dimensional (2D) drawing without being different from those according to the first and second embodiments. FIG. 38A is a view of a structure in which a plane layer is added at a ½ point between both face sheets to match wire crossing parts. FIG. 38B is a view of a structure in which two plane layers are respectively added at ¼ and ¾ points between both face sheets. FIG. 38C is a view of a structure in which, in a state where each of sewing distances xo and yo is set to about half of each of those according to the first and second embodiments, the wire crossing parts and the added plane layer match each other as shown in a dotted line, and also the added plane layer is disposed at a middle portion between the wire crossing parts as shown in a solid line. FIG. 38D is a view of a structure in which, in a state where each of sewing distances xo and yo is set to about half of each of those according to the first and second embodiments, the wire crossing parts and the added plane layer match each other as shown in a dotted line, and also, the added plane layer is disposed at a middle portion between the wire crossing parts as shown in a solid line. In the above-described structures, a simple flat plate, plain weaving, dow-weaving (or tri-axial weaving) fabric having a thickness less than that of each of the upper and lower face sheets, or a plain weaving or dow-weaving (or tri-axial weaving) mesh may be used as all of the above-described plane layers.

Fifth Embodiment

Figure 39:
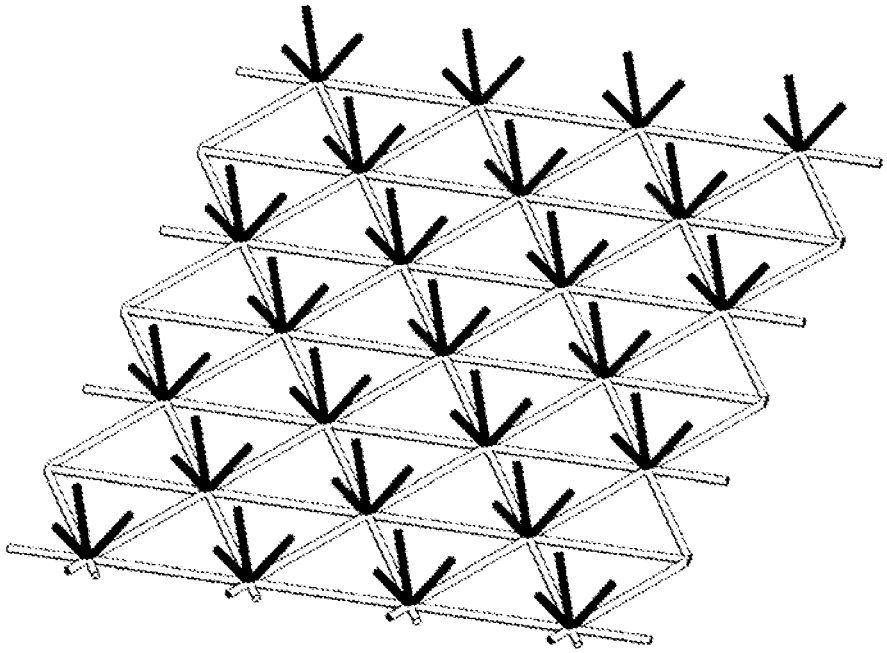
FIGS. 39 and 40 are views illustrating a structure of a core within a sandwich panel according to a fifth embodiment of the present invention.
Figure 39:
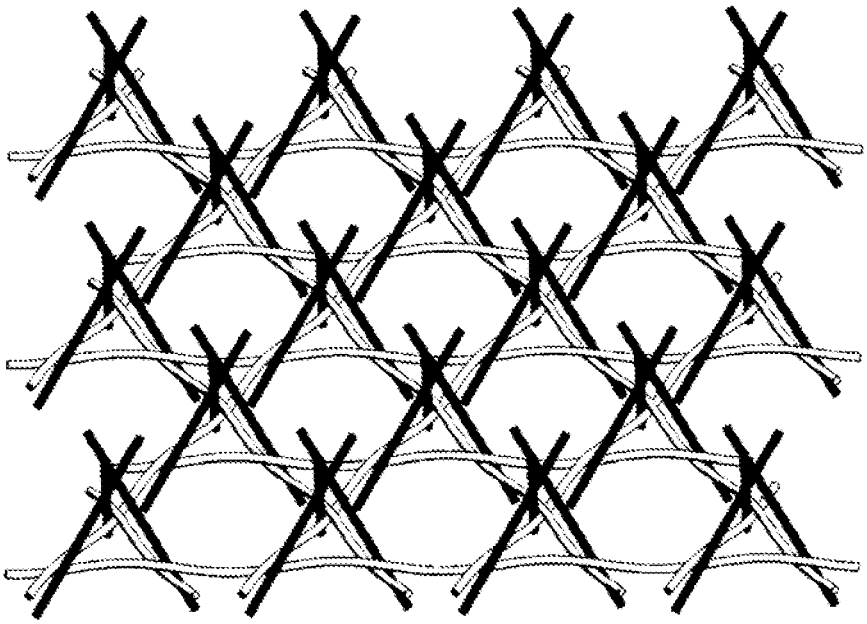
Figure 40:
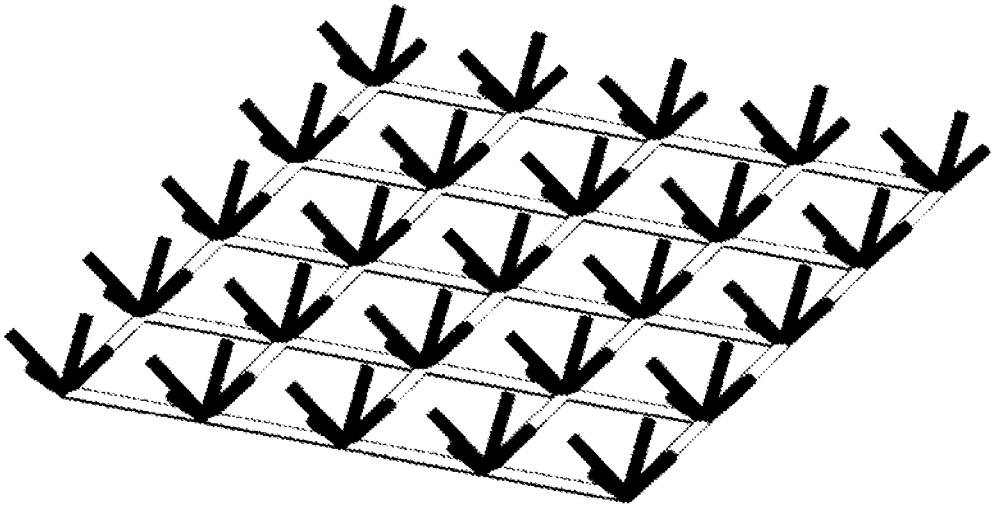
Figure 40:
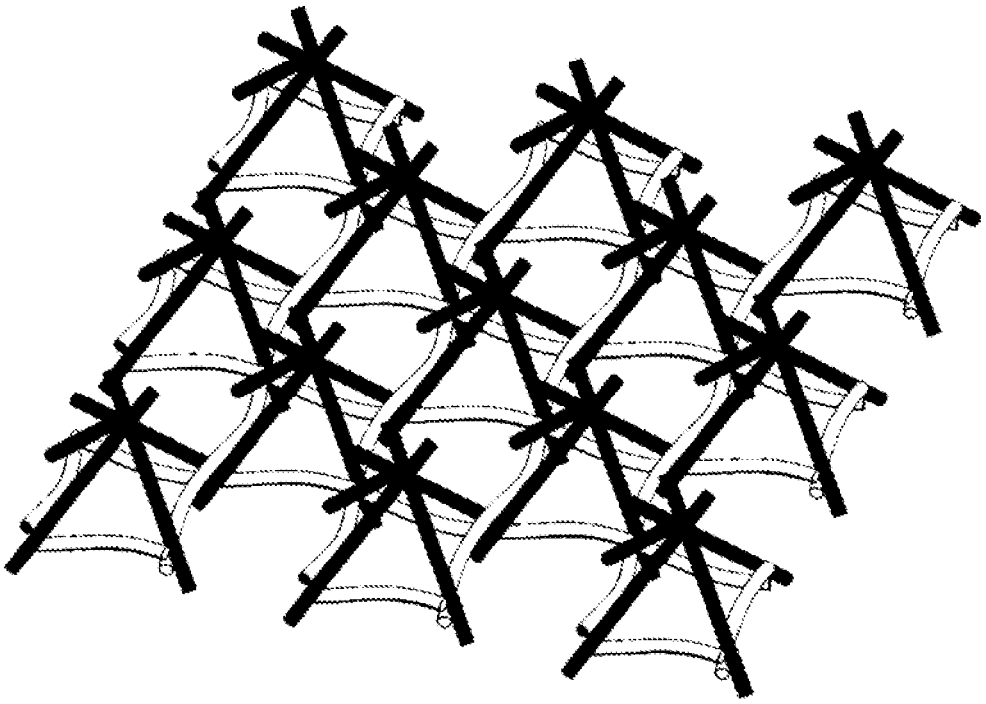

FIGS. 39 and 40 are views of a structure in which a plane layer within a sandwich panel having a 3D truss core and a wire inserted by passing through upper and lower face sheets cross each other according to the fifth embodiment of the present invention.

FIG. 39 is a view illustrating specific examples of the two structures in which the fourth embodiment is applied to the foregoing first embodiment. FIG. 39A is a view of a structure in which a crossing part between wires inserted by passing through upper and lower face sheets and a crossing part within a dow-weaving (or tri-axial weaving) mesh having a triangular hole and constituting a plane layer contact each other during the sewing. FIG. 39B is a view of a structure in which a middle point between crossing parts of wires inserted by passing through upper and lower face sheets contacts a crossing part within a weaving mesh having a 2D Kagome shape and constituting a plane layer during the sewing. FIG. 40 is a view illustrating specific examples of the two structures in which the fourth embodiment is applied to the foregoing second embodiment. FIG. 40A is a view of a structure in which a crossing part between wires inserted by passing through upper and lower face sheets and a crossing part within a plain weaving mesh having a square hole and constituting a plane layer contact each other during the sewing. FIG. 40B is a view of a structure in which a middle point between crossing parts of wires inserted by passing through upper and lower face sheets contacts a crossing part within a plain weaving mesh constituting a plane layer during the sewing.

Sixth Embodiment

Figure 41:
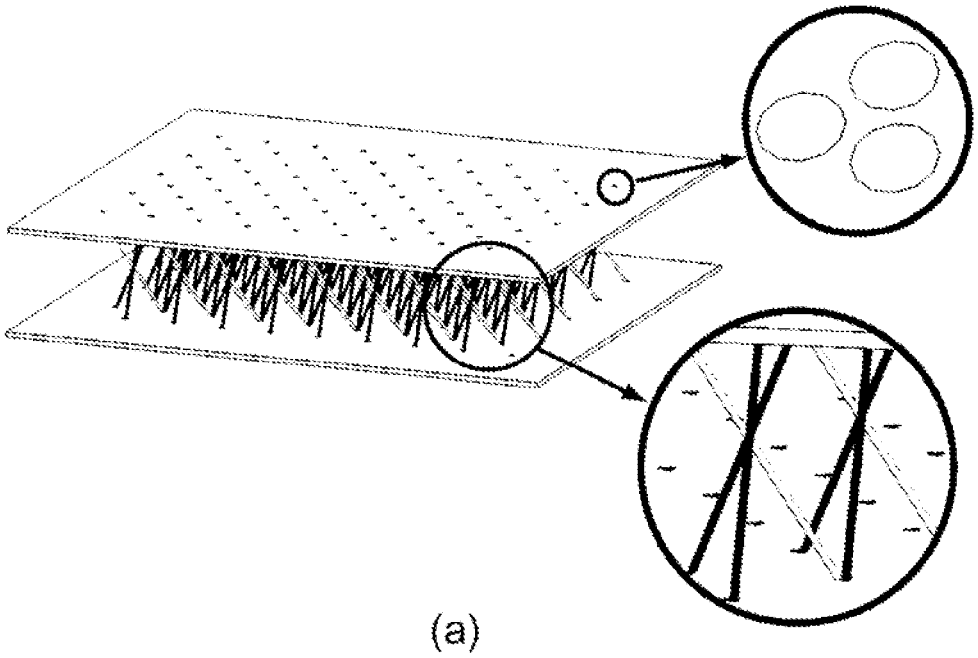
FIG. 41 is a perspective view and partial enlarged view of a sandwich panel according to a sixth embodiment of the present invention.
Figure 41:
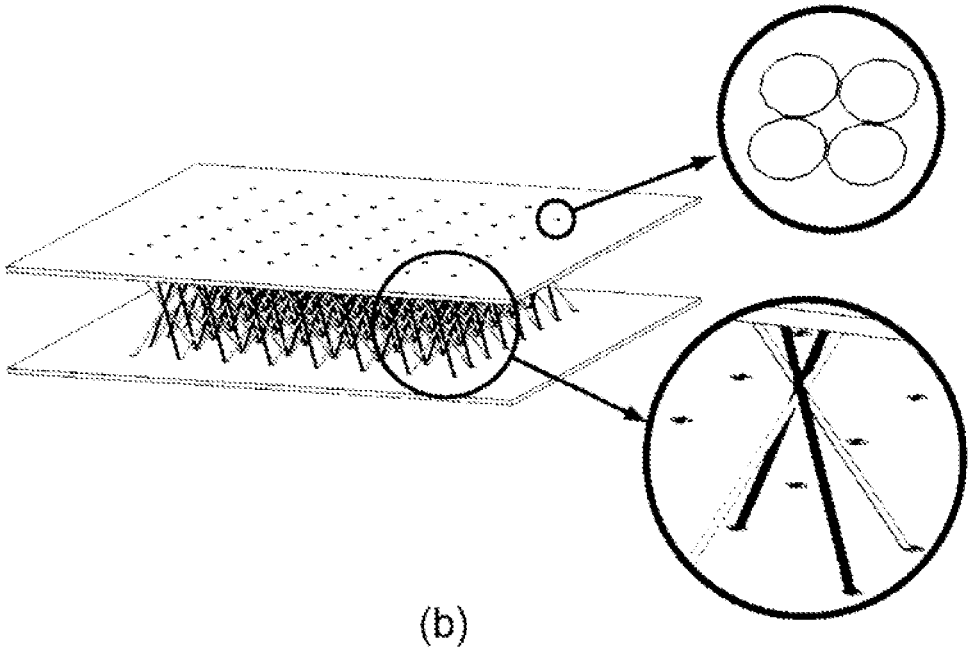

FIG. 41 is a view illustrating a case in which the wire inserted by passing through the upper and lower face sheets during the sewing in the first to fifth embodiments has a thick thickness. That is, the wires cross each other at the upper and lower face sheets and about ½ point between the face sheets in the 3D truss core formed of a wire. Since the wire is easily buckled by only slight eccentricity when a compression load is applied to the wire, the wire should be minimally bent. However, the bending of the wire at the crossing part may essentially occur. Thus, if the wire has a thick thickness, the bending of the wire may increase. FIG. 41 is a view of a structure in which sewing holes through which the wires disposed on the upper and lower face sheets pass are slightly missed each other so that the wires contact each other and also are maintained in a straight line to prevent a wire crossing part from being bent when each of the wires has a thick thickness.

Seventh Embodiment

Figure 42:
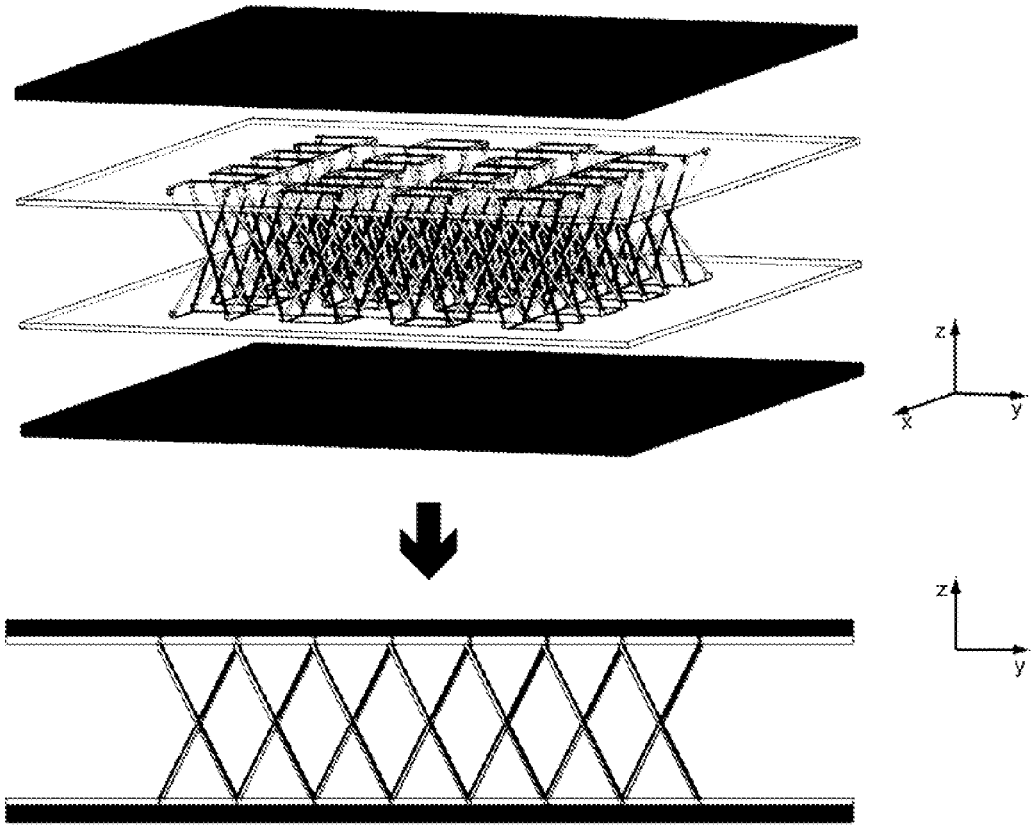
FIG. 42 is an exploded perspective view and cross-sectional view of a sandwich panel according to a seventh embodiment.

FIG. 42 is a view of a sandwich panel in which a sandwich panel is manufactured through the first to sixth embodiments, and then, separate face sheets are respectively attached to an upper portion of an upper face sheet and a lower portion of a lower face sheet. The wires may have strong resistance against a tensile force applied in a direction in which both face sheets are away from each other. However, if a compression force is applied in a direction in which both face sheets approach each other, since parts bonded to the face sheets depend on only strength of a resin adhesive, the wires may pushed from the face sheets. To prevent this phenomenon, separate face sheets are respectively attached to upper and lower portions of the upper and lower face sheets. As a more practical example, there is a structure in which, even though the upper and lower face sheets and the wires are impregnated in an epoxy resin, the upper and lower face sheets and the wires are provided as prepreg, and sheets additionally attached to the upper and lower face sheets are previously cured. When all wires are inserted through the sewing process, and cured thin sheets are additionally attached on the upper and lower portions of the upper and lower face sheets to make a vacuum between the sheets and heat the sheets, thereby bonding the upper and lower face sheets to the added sheets, the upper and lower face sheets and the sheets additionally attached thereto are cured in a state closely attached with respect to each other except a space occupied by the wire exposed to upper and lower sides of the upper and lower face sheets. Thus, even though a compression force is applied to the wires constituting a core, it may prevent the wires from being pushed from the core.

Eighth Embodiment

A sewing process in which upper and lower face sheets previously move in parallel to each other, and a wire vertically passes through the upper and lower face sheets to connect the upper and lower face sheets to each other may be performed through a process in which a wire inclinedly passes through upper and lower face sheets in a state where the upper and lower face sheets are fixed to sew the upper and lower face sheets, like the manufacturing process of the sheets according to the first and second embodiments. In this case, it is unnecessary to perform a process in which positions of the upper and lower face sheets which are relatively displaced after the sewing process is performed are recovered to their original positions or a process for maximally space sheets from each other after the sewing is finished.

That is, the eighth embodiment illustrates an example of the method in which the wire inclinedly passes through the upper and lower face sheets in the state where the upper and lower face sheets are fixed to sew the upper and lower face sheets. Thus, the manufactured sandwich panel may have the same structure as that of the sandwich panel according to the foregoing first embodiment. Also, a support used for manufacturing the sandwich panel according to the current embodiment may have a structure and a coupling configuration with a frame which are equal to those of each of the sandwich panels according to the foregoing first and second embodiments.

First, a wire is changed insertion angle so that the wire is inclined on an x-z plane at a predetermined angle ψ (hereinafter, referred to as a "first angle") in a counterclockwise direction and inclined on a y-z plane at a predetermined angle θ (hereinafter, referred to as a "second angle") in a clockwise direction. Then, the flexible wire passes through the upper and lower face sheets to reciprocation-sew the upper and lower face sheets. In this case, a sewing distance yo may be a displacement (hereinafter, referred to as a "second displacement") between wire through-parts of each of the upper and lower face sheets according to the second angle on the y-z plane. In a state where an x-axis coordinate is fixed, the face sheets are sewed from one ends thereof to the other ends in a y-axis direction to form a sewing row. When the sewing position reaches ends of the face sheets, the sewing position moves by a predetermined distance xo in the x-axis direction, and then, a sewing start point is displaced by half of the sewing distance yo to sew the face sheets in a reverse direction. In this case, the sewing distance xo may be a displacement (hereinafter, referred to as a "first displacement") between wire through-parts of each of the upper and lower face sheets according to the first angle on the x-z plane. When the sewing position reaches an opposite end, the x coordinate and the sewing start point are adjusted to repeatedly perform the sewing process. The above-described sewing process is called a "primary sewing".

Figure 43:
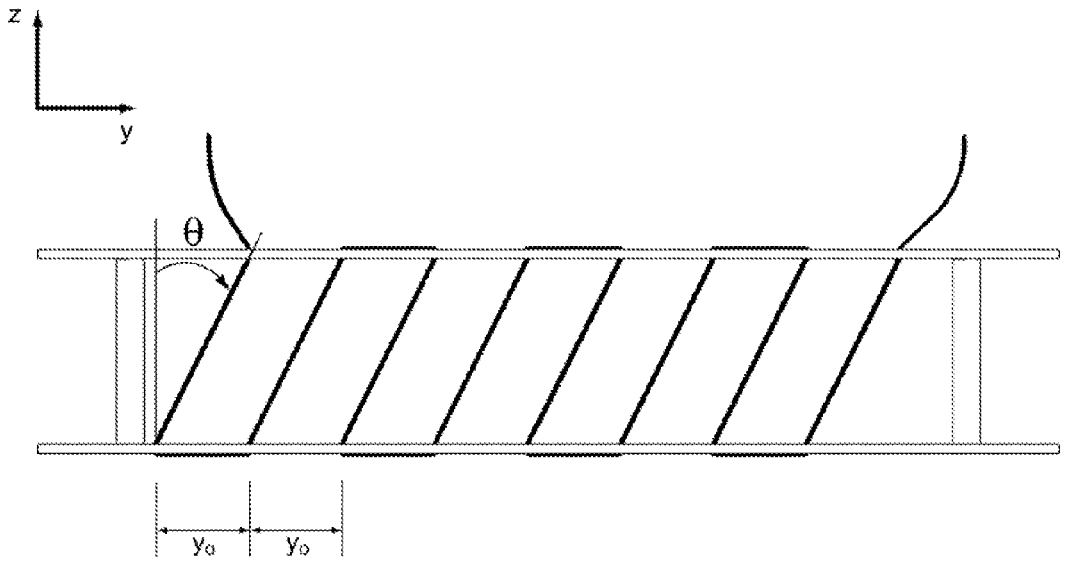
FIGS. 43 to 45 are views illustrating a method for manufacturing a panel according to an eighth embodiment of the present invention.

FIG. 43 is a view of a configuration on a y-z plane after the sewing is performed once from a left end to a right end in the state where the x coordinate is fixed in the initial stage of the primary sewing. A wire sewed inclinedly is disposed between the face sheets. The wire on the upper face sheet after the primary sewing is finished has the same arrangement as that of FIG. 12 according to the first embodiment.

In the next process, a wire is changed insertion angle so that the wire is inclined on the x-z plane at the predetermined angle w in the counterclockwise direction and inclined on the y-z plane at the predetermined angle θ in the clockwise direction. Thus, the insertion angle of the wire is inclined on the y-z plane at the angle θ in a direction exactly opposite to that of FIG. 43. Then, a sewing process, like the "primary sewing" is repeated. In this case, a position of a point passing through the face sheets may be equal to that of the "primary sewing". The above-described sewing process is called a "secondary sewing".

Figure 44:
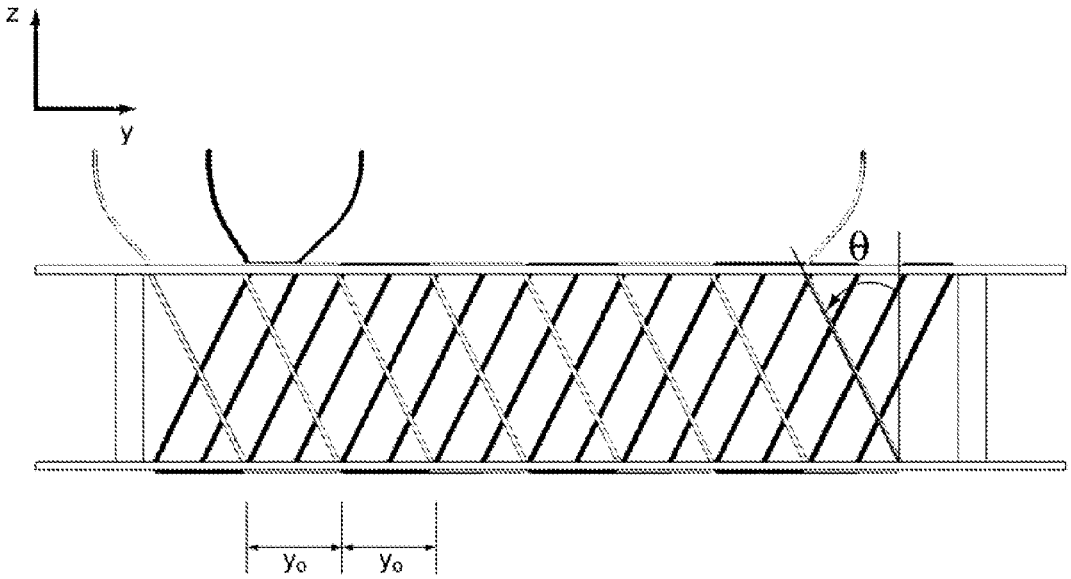

FIG. 44 is a view of a configuration on the y-z plane after the sewing is performed once from a left end to a right end in the state where the x coordinate is fixed in the initial stage of a secondary sewing. The wire on the upper face sheet after the "secondary sewing" is finished has the same arrangement as that of FIG. 15 according to the first embodiment. FIG. 44 is a view of a configuration in which the wires inserted during the "primary sewing" and the "secondary sewing" are inclined by angles +θ and −θ with respect to a vertical line (a z-axis direction), respectively.

In the next process, a wire is changed in insertion angle so that the wire is inclined on the x-z plane at the predetermined angle ψ in the counterclockwise direction. In this case, the insertion angle of the wire on the y-z plane is perpendicular to the x-y plane. The face sheets are sewed from one end on the y-axis in the x-axis direction. In a state where a sewing distance may be maintained to a certain distance 2*xo*, and a y coordinate may be fixed, the face sheets are straightly sewed from one ends thereof to the other ends in the x-axis direction. When the sewing position reaches ends of the face sheets, the sewing operation pauses, and then a y coordinate increases by a predetermined value yo/2. Then, a sewing start point is displaced by half of the sewing distance xo to sew the face sheets in a reverse direction. When the sewing position reaches an opposite end, the y coordinate and the sewing start point are adjusted to repeatedly perform the sewing process. The above-described sewing process is called a "tertiary sewing".

Figure 45:
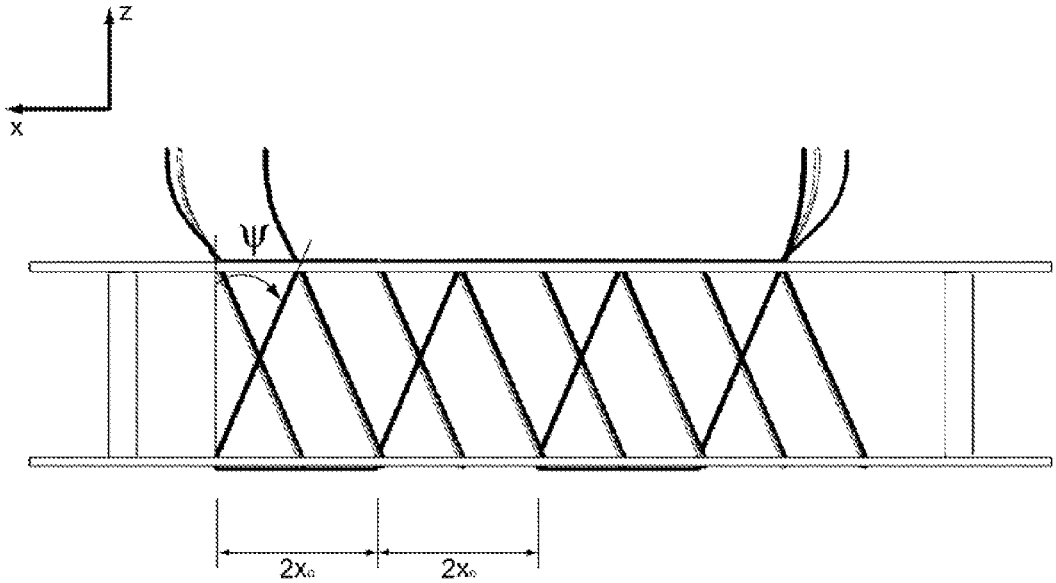

FIG. 45 is a view of a configuration on the x-z plane after the sewing is performed once from a left end to a right end in the state where the y coordinate is fixed in the initial stage of the "tertiary sewing". FIG. 44 is a view of a configuration in which the wires inserted during the primary sewing and the secondary sewing are inclined by angles +ψ and −ψ with respect to a vertical line (the z-axis direction), respectively. The wire on the upper face sheet after the "tertiary sewing" is finished has the same arrangement as that of FIG. 19 according to the first embodiment.

Lastly, contact parts between the wire inserted between the upper and lower face sheets and the upper and lower face sheets in the wire sewing process are fixed.

In case where a core is formed of a flexible wire (e.g., a metal) having a predetermined stiffness in itself, satisfied compression, shearing, and bending strength to weight ratio on the basis of the stiffness of the wire in itself and mechanical structure of the truss may be achieved. If the core is formed of a wire material having an insufficient stiffness in itself such as a uni-directional yarn, a 3-D truss structure may be formed by using a semi-cured wire in which a coupling material such as a resin is previously impregnated to cure the 3-D truss structure. Alternatively, a 3-D truss structure may be formed, and then, a separate resin may be sprayed to impregnate the 3-D truss structure in the resin, thereby curing the 3-D truss structure. As a result, the face sheet contact parts, the wire, and wire cross parts may be fixed at the same time to manufacture an economical and high-strength sandwich panel having a simple structure. Particularly, in case where the wire material includes carbon and glass yarn, a 3D truss structure may be formed in a semi-cured state in which a coupling material such as a resin is previously impregnated to cure the 3D truss structure. Alternatively, a 3D truss structure may be formed, and then, separate liquid syntactic resin bond such as epoxy may be sprayed or coated, or the 3D truss structure is impregnated into the liquid syntactic resin bond to cure the 3D truss structure.

The sandwich panel manufactured through the above-described process may be equal to that of FIG. 21 according to the first embodiment. The core may have a structure in which edges of two-layered 3D tetrahedral trusses face each other.

Ninth Embodiment

That is, the ninth embodiment illustrates an example of the method in which the wire inclinedly passes through the upper and lower face sheets in the state where the upper and lower face sheets are fixed to sew the upper and lower face sheets. Thus, the manufactured sandwich panel may have the same structure as that of the sandwich panel according to another embodiment. Also, a support used for manufacturing the sandwich panel may have a structure and a coupling configuration with a frame which are equal to those of each of the sandwich panels according to the foregoing first, second, and eighth embodiments.

Figure 46:
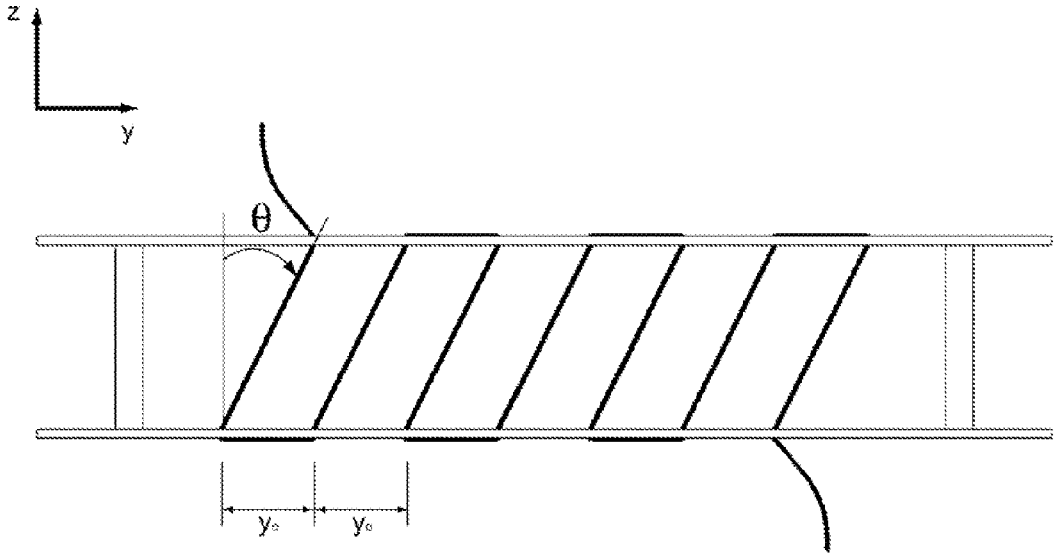
FIGS. 46 to 49 are views illustrating a method for manufacturing a panel according to a ninth embodiment of the present invention.

First, an insertion angle of a wire is changed so that the wire is inclined on an x-z plane at a predetermined angle ψ (hereinafter, referred to as a "first angle") in a counterclockwise direction and inclined on a y-z plane at a predetermined angle θ (hereinafter, referred to as a "second angle") in a clockwise direction. A flexible wire passes through upper and lower face sheets to reciprocation-sew the upper and lower face sheets. Here, a sewing distance yo may be a displacement (hereinafter, referred to as a "second displacement") between wire through-parts of each of the upper and lower face sheets according to the second angle on the y-z plane. In a state where an x coordinate is fixed, the face sheets are sewed from one ends thereof to the other ends in a y-axis direction. Then, when the sewing position reaches ends of the face sheets, the sewing operation pauses, and then the x coordinate increases by a predetermined value xo. Thereafter, the face sheets are reversely sewed in a direction parallel to the y-axis direction. The sewing distance xo may be a displacement (hereinafter, referred to as a "first displacement") between wire through-parts of each of the upper and lower face sheets according to the first angle on the x-z plane. When the sewing position reaches an opposite end, the x coordinate is adjusted to repeatedly perform the sewing process. The above-described sewing process is called a "primary sewing". FIG. 46 is a view of a configuration on the y-z plane after the sewing is performed once from a left end to a right end in the state where the x coordinate is fixed in the initial stage of the primary sewing. The wire on the upper face sheet after the primary sewing is finished has the same arrangement as that of FIG. 25 according to the second embodiment.

Figure 47:
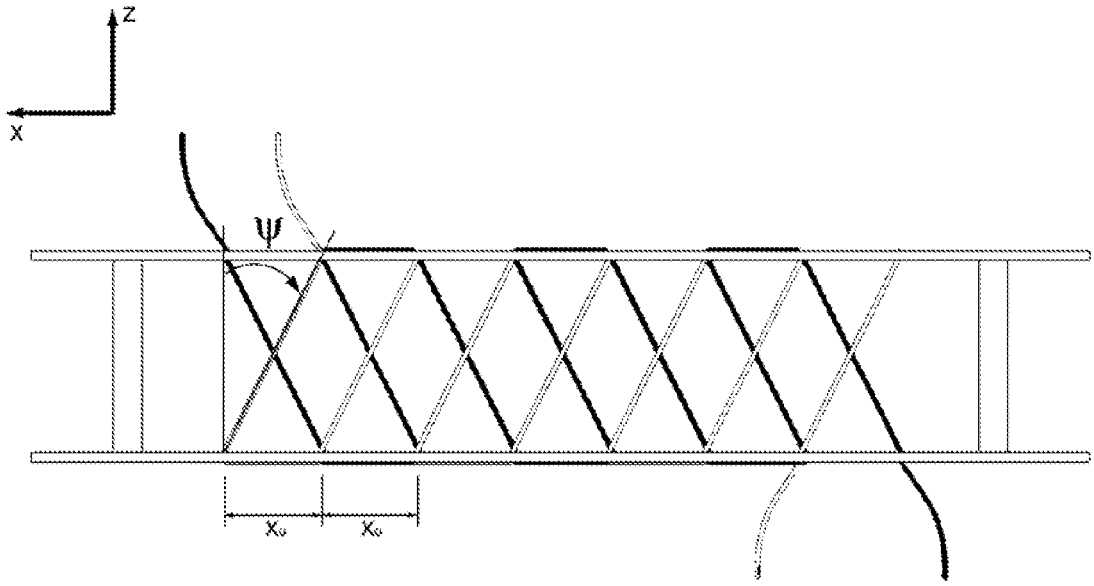

In the next process, an insertion angle of a wire is changed so that the wire is inclined on the x-z plane at the predetermined angle ψ in a clockwise direction and inclined on the y-z plane at the predetermined angle θ in a counterclockwise direction. Thus, the insertion angle of the wire is inclined at the angle ψ in a direction exactly opposite to that of FIG. 46. Then, the above-described sewing process is repeated. A position of a point passing through the face sheets is equal to that of the first embodiment. Here, the sewing distance xo is equal to the first displacement. In a state where a y coordinate is fixed, the face sheets are sewed from one ends thereof to the other ends in an x-axis direction. Then, when the sewing position reaches ends of the face sheets, the sewing operation pauses, and then the y coordinate increases by a predetermined value yo. Thereafter, the face sheets are reversely sewed in a direction parallel to the x-axis direction. The sewing distance yo is equal to the second displacement. When the sewing position reaches an opposite end, the y coordinate is adjusted to repeatedly perform the sewing process. The above-described sewing process is called a "secondary sewing". FIG. 47 is a view of a configuration on the x-z plane after the sewing is performed once from a left end to a right end in the state where the y coordinate is fixed in the initial stage of the secondary sewing. The wire on the upper face sheet after the secondary sewing is finished has the same arrangement as that of FIG. 28 according to the second embodiment.

Figure 48:
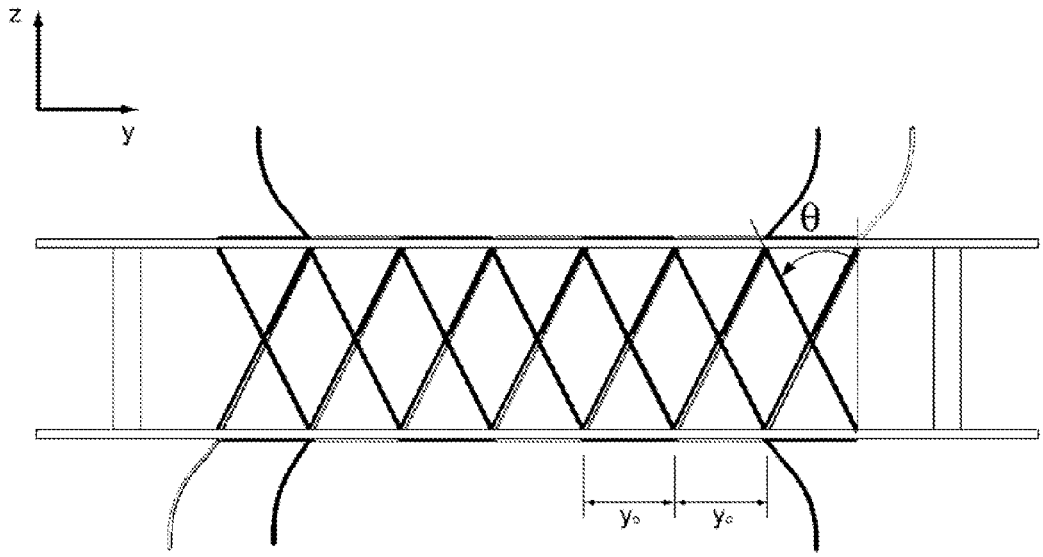

In the next process, an insertion angle of a wire is changed so that the wire is inclined on the x-z plane at the predetermined angle ψ in the clockwise direction and inclined on the y-z plane at the predetermined angle θ in the counterclockwise direction. In a state where the x coordinates of the face sheets are fixed, the face sheets are sewed from a right end to a left end on the y-axis. The face sheets are sewed at a constant sewing distance yo. Then, when the sewing position reaches ends of the face sheets, the sewing operation pauses, and then the x coordinate increases by a predetermined value xo. Thereafter, the face sheets are reversely sewed in a direction parallel to the y-axis direction. When the sewing position reaches an opposite end, the x coordinate is adjusted to repeatedly perform the sewing process in a reverse direction. The above-described sewing process is called a "tertiary sewing". FIG. 48 is a view of a configuration on the y-z plane after the sewing is performed once from a right end to a left end in the state where the x coordinate is fixed in the initial stage of the tertiary sewing. The wire on the upper face sheet after the tertiary sewing is finished has the same arrangement as that of FIG. 31 according to the second embodiment.

Figure 49:
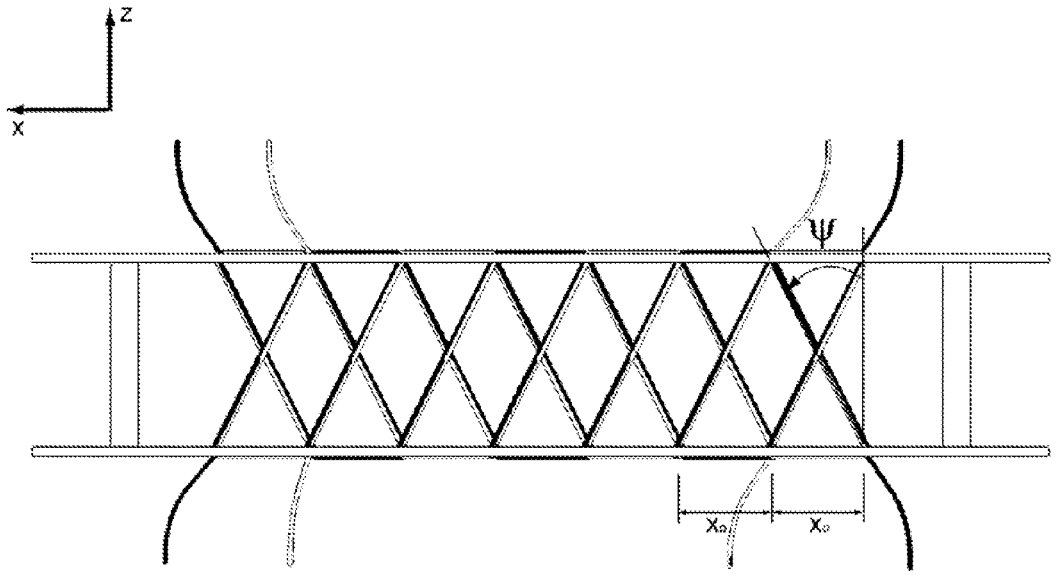

In the next process, an insertion angle of a wire is changed so that the wire is inclined on the x-z plane at the predetermined angle ψ in the counterclockwise direction and inclined on a y-z plane at the predetermined angle θ in the clockwise direction. In a state where the y coordinates of the face sheets are fixed, the face sheets are sewed from a right end to a left end on the x-axis. The face sheets are sewed at a constant sewing distance xo. Then, when the sewing position reaches ends of the face sheets, the sewing operation pauses, and then the y coordinate increases by a predetermined value yo. Thereafter, the face sheets are reversely sewed in a direction parallel to the x-axis direction. When the sewing position reaches an opposite end, the y coordinate is adjusted to repeatedly perform the sewing process in a reverse direction. The above-described sewing process is called a "quartic sewing". FIG. 49 is a view of a configuration on the x-z plane after the sewing is performed once from a right end to a left end in the state where the y coordinate is fixed in the initial stage of the quartic sewing. The wire on the upper face sheet after the quartic sewing is finished has the same arrangement as that of FIG. 40 according to the second embodiment.

Lastly, like the eighth embodiment, the support shaft between the upper and lower face sheets is separated, and then the upper and lower face sheets extends in directions opposite to each other so that both face sheets are away from each other. Then, in a state where the wires inserted between the upper and lower face sheets are straightly pulled in parallel to each other during the sewing process of the wires, contact parts between the wires and the upper and lower face sheets are fixed.

Also, like the foregoing eighth embodiment, in case where a core is formed of a flexible wire (e.g., a metal) having a predetermined stiffness in itself, satisfied compression, shearing, and bending strength to weight ratio on the basis of the stiffness of the wire in itself and mechanical structure of the truss may be achieved. If the core is formed of a wire material having an insufficient stiffness in itself such as a uni-directional yarn, a 3-D truss structure may be formed by using a semi-cured wire in which a coupling material such as a resin is previously impregnated to cure the 3-D truss structure. Alternatively, a 3-D truss structure may be formed, and then, a separate resin may be sprayed to impregnate the 3-D truss structure in the resin, thereby curing the 3-D truss structure. As a result, the face sheet contact parts, the wire, and wire cross parts may be fixed at the same time to manufacture an economical and high-strength sandwich panel having a simple structure. Particularly, in case where the wire material includes carbon and glass yarn, a 3D truss structure may be formed in a semi-cured state in which a coupling material such as a resin is previously impregnated to cure the 3D truss structure. Alternatively, a 3D truss structure may be formed, and then, separate liquid syntactic resin bond such as epoxy may be sprayed or coated, or the 3D truss structure is impregnated into the liquid syntactic resin bond to cure the 3D truss structure.

The sandwich panel manufactured through the above-described process may be equal to that of FIG. 35 according to the second embodiment. The core may have a shape in which edges of two-layered trusses having a shape similar to a pyramid shape face each other.

The technical concepts of the present invention are used only for explain a specific exemplary embodiment while not limiting the present invention, and thus, the detailed description may be amended or modified according to viewpoints and applications, not being out of the scope, technical idea and other objects of the present invention.

For example, the plurality of wires used in the sewing process may be provided as physically separated wires or continuous one wire.

Also, the frame serving as a face sheet fixing unit described in the embodiments and the support serving as a frame spacing unit may be substituted with other units, respectively.

Figure 50:
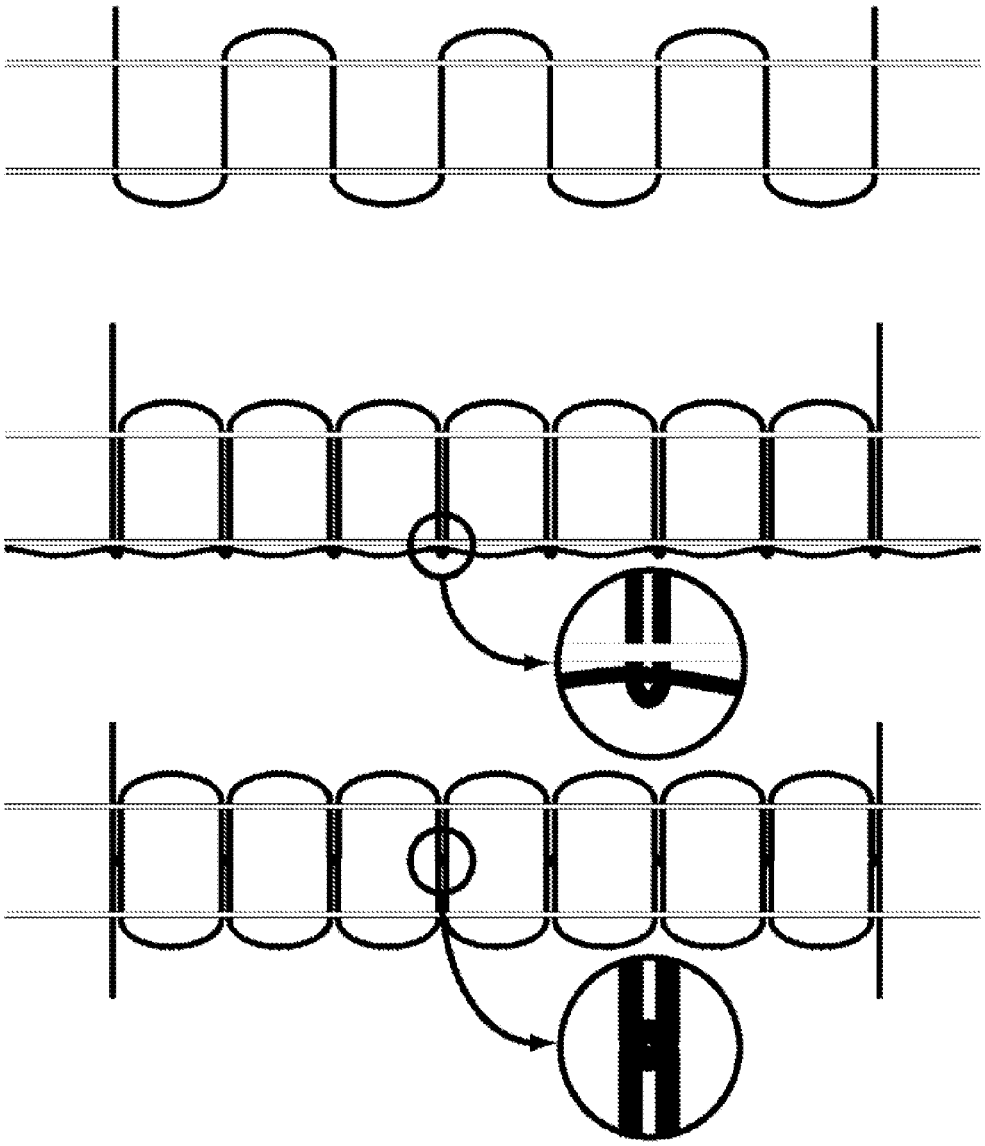
FIG. 50 is a view illustrating a method for manufacturing a sandwich panel to which a general sewing method is applied according to another embodiment of the present invention.

Also, the sewing process may be performed by twisting an upper thread and a lower thread with respect to each other like a general sewing process, but not reciprocating one wire between the upper and lower face sheets (see FIG. 50). In this case, when the one wire is continuously reciprocated along the through-parts of the upper and lower face sheets in the sewing process to sew the upper and lower face sheets, like the above-described embodiments, fraction resistance may increase in proportion to the sewing distance, and also, a problem in which the wire through-part formed in the initial stage unintentionally increases in diameter may be solved.

The invention claimed is:

1. A method for manufacturing a sandwich panel comprising a core having a truss structure between upper and lower face sheets, the method comprising:

disposing the upper and lower face sheets in parallel to each other at a predetermined distance in a vertical direction;

sewing the upper and lower face sheets by repeatedly performing, several times, a process in which a plurality of flexible wires vertically pass through the upper and lower face sheets to reciprocation-connect the upper and lower face sheets to each other;

inclining the vertically sewed flexible wires in one direction by relatively moving in the horizontal direction the upper and lower face sheets in parallel to each other;

increasing a distance in the vertical direction between the upper and lower face sheets sewed by the flexible wires while the upper and lower face sheets are maintained in a parallel to each other; and fixing the upper and lower face sheets and the wires to each other.

2. The method of claim 1, wherein at least one panel is added between the upper and lower sheets.

3. The method of claim 1, wherein the wire through-positions on the upper and lower sheets are different from each other in the sewing processes.

4. The method of claim 1, further comprising coupling a reinforcing plate to at least one of the upper and lower sheets after the face sheets and the wires are fixed.

5. The method of claim 1, wherein the plurality of wires comprise one continuous wire.

6. The method of claim 1, wherein each of the wires is formed of a metal or fiber material.

7. The method of claim 1, wherein each of the wires is formed of fiber material, wherein face sheet contact parts, the wires, and wire crossing parts are cured and fixed at the same time by using an adhesive.

8. The method of claim 1, wherein the disposing the upper and lower face sheets includes making a relative displacement in the horizontal direction between the upper and lower face sheets, wherein the inclining the vertically sewed wires includes removing the relative displacement in the horizontal direction between the upper and lower face sheets by the relative moving in the horizontal direction the upper and lower face sheets.

9. The method of claim 1, wherein each of the upper and lower face sheets includes a plurality of sewing holes through which the wires pass.

10. A method for manufacturing a panel comprising a core having a truss structure between upper and lower face sheets, the method comprising:

disposing the upper and lower face sheets in parallel to each other at a predetermined distance;

repeatedly performing, several times, a process in which a plurality of flexible wires vertically pass through the upper and lower face sheets to reciprocation-connect the upper and lower face sheets to each other, thereby sewing the upper and lower face sheets after the upper and lower face sheets horizontally move in parallel to each other; and maximally spacing both face sheets in a vertical direction while being maintained in a parallel to each other after a relative displacement of the upper and lower face sheets is solved, and fixing the face sheets and the wires to each other, wherein the sewing of the upper and lower face sheets comprises:

(a) relatively moving the upper and lower face sheets in parallel to each other so that a virtual z-directional vertical axis passing through the upper and lower face sheets is inclined on an x-z plane at a first angle in a positive direction of an x-axis and on a y-z plane at a second angle in a negative direction of a y-axis;

(b) performing a first sewing process in which the upper and lower face sheets are reciprocation-sewed in a y-axis direction by using a first wire, wherein a sewing distance in the y-axis direction corresponds to a second displacement distance of the face sheets according to the second angle, continuous wire sewing rows are spaced apart from each other by a first displacement distance of the face sheets according to the first angle, and ends of the sewing rows adjacent to each other are displaced by about ½ of the second displacement distance in the y-axis direction;

(c) relatively moving the upper and lower face sheets in parallel to each other so that a support shaft is inclined on the y-z plane at an angle corresponding to about two times of the second angle in the positive direction of the y-axis;

(d) performing a second sewing process in which the upper and lower face sheets are reciprocation-sewed in the y-axis direction by using a second wire, wherein, since through-positions of the wires with respect to the face sheets are the same as those of the wires in the first sewing process, the second sewing process is performed through the same method as the first sewing process;

(e) relatively moving the upper and lower face sheets in parallel to each other so that the support shaft is inclined on the y-z plane at the second angle in the negative direction of the y-axis, and the support shaft is inclined on the x-z plane at an angle corresponding to about two times of the first angle in a negative direction of the x-axis; and (f) reciprocation-sewing the upper and lower face sheets in an x-axis direction by using a third wire, wherein a sewing distance in the x-axis direction is double first displacement distance, continuous wire sewing rows are spaced about ½ of the second displacement distance from each other, and ends of the sewing row adjacent to each other are displaced by the first displacement distance in the x-axis direction.

11. The method of claim 10, wherein the sewing distances and the distance between the sew rows in the sewing processes are different by two times.

12. A method for manufacturing a panel comprising a core having a truss structure between upper and lower face sheets, the method comprising:

disposing the upper and lower face sheets in parallel to each other at a predetermined distance;

repeatedly performing, several times, a process in which a plurality of flexible wires vertically pass through the upper and lower face sheets to reciprocation-connect the upper and lower face sheets to each other, thereby sewing the upper and lower face sheets after the upper and lower face sheets horizontally move in parallel to each other; and maximally spacing both face sheets in a vertical direction while being maintained in a parallel to each other after a relative displacement of the upper and lower face sheets is solved, and fixing the face sheets and the wires to each other, wherein the sewing of the upper and lower face sheets comprises:

(a) relatively moving the upper and lower face sheets in parallel to each other so that a virtual z-directional vertical axis passing through the upper and lower face sheets is inclined on an x-z plane at a first angle in a positive direction of an x-axis and on a y-z plane at a second angle in a negative direction of a y-axis;

(b) performing a first sewing process in which the upper and lower face sheets are reciprocation-sewed in a y-axis direction by using a first wire, wherein a sewing distance in the y-axis direction corresponds to a second displacement distance of the face sheets according to the second angle, and continuous wire sewing rows are spaced apart from each other by a first displacement distance of the face sheets according to the first angle;

(c) relatively moving the upper and lower face sheets in parallel to each other so that a support shaft is inclined on the x-z plane at an angle corresponding to about two times of the first angle in a negative direction of the x-axis;

(d) performing a second sewing process in which the upper and lower face sheets are reciprocation-sewed in the x-axis direction by using a second wire, wherein through-positions of the wires with respect to the face sheets are the same as those of the wires in the first sewing process, a sewing distance in the x-axis direction corresponds to the first displacement distance of the face sheets according to the first angle, and continuous wire sewing rows are spaced apart from each other by the second displacement distance of the face sheets according to the second angle in the y-axis direction;

(e) relatively moving the upper and lower face sheets in parallel to each other so that a support shaft is inclined on the y-z plane at an angle corresponding to about two times of the first angle in a positive direction of the y-axis;

(f) performing a third sewing process in which the upper and lower face sheets are reciprocation-sewed in the y-axis direction by using a third wire, wherein through-positions of the wires with respect to the face sheets are the same as those of the wires in the first and second sewing processes, a sewing distance in the y-axis direction corresponds to the second displacement distance of the face sheets according to the second angle, and continuous wire sewing rows are spaced apart from each other by the first displacement distance of the face sheets according to the first angle in the x-axis direction;

(g) relatively moving the upper and lower face sheets in parallel to each other so that a support shaft is inclined on the x-z plane at an angle corresponding to about two times of the first angle in a positive direction of the x-axis; and (h) performing a fourth sewing process in which the upper and lower face sheets are reciprocation-sewed in the x-axis direction by using a fourth wire, wherein through-positions of the wires with respect to the face sheets are the same as those of the wires in the first to third sewing processes, a sewing distance in the x-axis direction corresponds to the first displacement distance of the face sheets according to the first angle, and continuous wire sewing rows are spaced apart from each other by the second displacement distance of the face sheets according to the second angle in the y-axis direction.

13. The method of claim 12, wherein the sewing distances and the distance between the sew rows in the sewing processes are different by two times.

* * * * *